US007328687B2

(12) United States Patent
Kojima

(10) Patent No.: US 7,328,687 B2
(45) Date of Patent: Feb. 12, 2008

(54) FUEL SUPPLY APPARATUS FOR INTERNAL COMBUSTION ENGINE

(75) Inventor: Susumu Kojima, Susomo (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 195 days.

(21) Appl. No.: 11/114,129

(22) Filed: Apr. 26, 2005

(65) Prior Publication Data

US 2005/0241617 A1 Nov. 3, 2005

(30) Foreign Application Priority Data

Apr. 28, 2004 (JP) ..... 2004-134205

(51) Int. Cl.
*F02B 7/00* (2006.01)
*F02B 7/04* (2006.01)

(52) U.S. Cl. ..... 123/431; 123/299

(58) Field of Classification Search ..... 123/431, 123/456, 299, 300, 305, 478, 304, 575, 446, 123/510, 511, 447
See application file for complete search history.

(56) References Cited

U.S. PATENT DOCUMENTS 5,875,743 A 3/1999 Dickey
6,073,608 A * 6/2000 Krieger et al. ..... 123/299
6,112,721 A * 9/2000 Kouketsu et al. ..... 123/447
6,240,901 B1 * 6/2001 Jay ..... 123/446
6,253,735 B1 * 7/2001 Miyajima ..... 123/456
6,314,940 B1 11/2001 Frey et al.
6,378,498 B2 * 4/2002 Kohketsu et al. ..... 123/447
6,647,938 B2 * 11/2003 Gaessler et al. ..... 123/179.17
6,792,919 B2 * 9/2004 Kohketsu et al. ..... 123/447
6,823,844 B2 * 11/2004 Steinbrenner et al. ..... 123/446
6,889,656 B1 * 5/2005 Rembold et al. ..... 123/446
2002/0092504 A1 * 7/2002 Kohketsu et al. ..... 123/447
2005/0188958 A1 * 9/2005 Klenk et al. ..... 123/458

FOREIGN PATENT DOCUMENTS

DE 10127516 A1 * 12/2002
EP 1 179 676 A1 2/2002

(Continued)

OTHER PUBLICATIONS

Online machine translation of DE10127516 [online],[retrieved on May 24, 2007], <retrieved from European Patent Office online machine translation service>.*

*Primary Examiner*—Mahmoud Gimie
(74) *Attorney, Agent, or Firm*—Kenyon & Kenyon LLP

(57) ABSTRACT

A fuel supply apparatus includes: a low-pressure fuel system applying pressure to a fuel in a fuel tank by using a first low-pressure pump and supplying the fuel to port fuel injection valves; a high-pressure fuel system applying pressure to the fuel in the fuel tank by using a second low-pressure pump, applying further pressure to the fuel by using a high-pressure pump driven by an internal combustion engine, and supplying the fuel to in-cylinder fuel injection valves; and an ECU controlling actuation of at least the first low-pressure pump and the second low-pressure pump in accordance with an operation state of the internal combustion engine. As the low-pressure fuel system and the high-pressure fuel system are independent of each other, pulsation generated from the high-pressure pump does not propagate to the port fuel injection valves.

16 Claims, 9 Drawing Sheets

FOREIGN PATENT DOCUMENTS

| | | |
|---|---|---|
| EP | 1 505 293 A1 | 2/2005 |
| EP | 1 531 261 A1 | 5/2005 |
| JP | 07-103048 | 4/1995 |
| JP | 10-073062 | 3/1998 |
| JP | 2000-274329 A | 10/2000 |
| JP | 2001-207927 | 8/2001 |

* cited by examiner

FUEL SUPPLY APPARATUS FOR INTERNAL COMBUSTION ENGINE

This nonprovisional application is based on Japanese Patent Application No. 2004-134205 filed with the Japan Patent Office on Apr. 28, 2004, the entire contents of which are hereby incorporated by reference.

BACKGROUND OF THE INVENTION

1. Field of the Invention

The present invention relates to a fuel supply apparatus for an internal combustion engine, and more particularly to a fuel supply apparatus for an internal combustion engine supplying the internal combustion engine with a fuel by using low-pressure fuel supply means and high-pressure fuel supply means.

2. Description of the Background Art

Examples of a method of supplying a fuel to an internal combustion engine such as a gasoline engine and a diesel engine incorporated in a vehicle such as a passenger car, a truck, or the like include in-cylinder injection for directly injecting the fuel into a combustion chamber within a cylinder of the internal combustion engine, port injection for injecting the fuel into an intake port for taking air into the combustion chamber within the cylinder of the internal combustion engine, and a combination thereof, that is, in-cylinder injection/port injection switching between in-cylinder injection and port injection in accordance with an operation state of the internal combustion engine.

For example, Japanese Patent Laying-Open No. 7-103048 discloses a fuel supply apparatus for an internal combustion engine carrying out in-cylinder injection/port injection in accordance with an operation state of the internal combustion engine described above. The fuel supply apparatus for the internal combustion engine (a fuel injection apparatus) includes a port fuel injection valve serving as low-pressure fuel supply means for performing port injection (a fuel injection valve for injection into an engine intake manifold) and an in-cylinder fuel injection valve serving as high-pressure fuel supply means for performing in-cylinder injection (a fuel injection valve for in-cylinder injection). The fuel supply apparatus for the internal combustion engine controls injection from the in-cylinder fuel injection valve and the port fuel injection valve, that is, controls injection timing and a quantity of injection, in accordance with a map prepared based on a fuel supply quantity (a fuel injection quantity) and degree of accelerator press-down (an amount of press-down of an accelerator pedal). Specifically, the map is divided into an injection region where solely the in-cylinder fuel injection valve is used, an injection region where both of the in-cylinder fuel injection valve and the port fuel injection valve are used, and an injection region where solely the port fuel injection valve is used. Then, an ECU (Engine Control Unit) controls injection from the in-cylinder fuel injection valve and/or the port fuel injection valve in accordance with the operation state of the internal combustion engine.

Generally, when the fuel is injected into the combustion chamber within the cylinder from the in-cylinder fuel injection valve as described above, the fuel supply apparatus for the internal combustion engine should inject a high-pressure fuel. Therefore, the fuel supply apparatus includes a high-pressure pump for supplying a high-pressure fuel to the in-cylinder fuel injection valve. The high-pressure pump applies pressure to the fuel in the following manner. A cam for the pump attached to an intake camshaft or an exhaust camshaft rotates as a result of transfer of rotation force from a crankshaft of the internal combustion engine, and a plunger is caused to carry out reciprocating motion. Then, the fuel to which pressure has been applied by a low-pressure pump is suctioned into a pressurizing chamber of the high-pressure pump, in which further pressure is applied.

The high-pressure pump continues to be driven by rotation of the crankshaft of the internal combustion engine, even under the control by an ECU so as not to supply the fuel from the high-pressure fuel supply means to the internal combustion engine, that is, so as not to inject the fuel from the in-cylinder fuel injection valve. Consequently, pulsation is produced when the high-pressure pump suctions the fuel from a high-pressure fuel system or when excessive fuel is returned. Pulsation fluctuates pressure of the fuel, i.e., fuel pressure, in the high-pressure fuel system and the low-pressure fuel system. Such fluctuation in the fuel pressure propagates to the low-pressure fuel supply means, that is, a low-pressure fuel delivery pipe supplying the fuel within a low-pressure pipe to the port fuel injection valve provided corresponding to each cylinder or a fuel injection valve for each port. Though the ECU controls injection timing and a quantity of fuel to be injected from the port fuel injection valve to the intake port in an intake system of the internal combustion engine in accordance with the operation state of the internal combustion engine, the port fuel injection valve has not been able to inject the fuel of an injection supply quantity, that is, a fuel injection quantity, determined based on the operation state of the internal combustion engine, due to propagation of pulsation to the low-pressure fuel delivery pipe or to the port injection valve.

Particularly in a V-type 6-cylinder engine including two cylinder groups each consisting of three cylinders, pulsation generated from the high-pressure pump propagates to the low-pressure fuel delivery pipe provided in each cylinder group, and further to the port fuel injection valve provided for each cylinder from the low-pressure fuel delivery pipe. Here, if a pipe from the high-pressure pump to each low-pressure fuel delivery pipe has the same length, a phase of a cycle of a magnitude of pressure fluctuation caused by pulsation, of the fuel supplied to the port fuel injection valve is the same. If injection timing of each port fuel injection valve has a cycle half the magnitude of pressure fluctuation of the fuel, the fuel is injected from the port fuel injection valve provided in one cylinder group at the time when the magnitude of pressure fluctuation of the fuel attains an upper limit, whereas the fuel is injected from the port fuel injection valve provided in the other cylinder group at the time when the magnitude of pressure fluctuation of the fuel attains a lower limit. That is, if a valve-open time period, i.e., an electrified time period, of the port fuel injection valves is the same among one another under the control of the ECU, variation in a quantity of fuel injected from the port fuel injection valve for each cylinder group becomes significant. As described above, the fuel supply apparatus has not been able to supply the fuel of a quantity to be supplied to the internal combustion engine, and an air-fuel ratio representing a ratio between air and the fuel has disadvantageously fluctuated.

SUMMARY OF THE INVENTION

The present invention was made in view of the above, and an object of the present invention is to provide a fuel supply apparatus for an internal combustion engine capable of mitigating influence by pulsation generated at least in a high-pressure pump on a quantity of fuel to be supplied to the internal combustion engine.

In order to solve the above-described problems as well as to achieve the aforementioned object, a fuel supply apparatus for an internal combustion engine according to the present invention includes: a low-pressure fuel system applying pressure to a fuel within an accumulator by using a first low-pressure pump and supplying the fuel to low-pressure fuel supply means through a first low-pressure pipe; a high-pressure fuel system applying pressure to the fuel in the accumulator by using a second low-pressure pump, applying further pressure through a second low-pressure pipe to the fuel by using a high-pressure pump driven by the internal combustion engine, and supplying the fuel to high-pressure fuel supply means; and pump control means for controlling actuation of at least the first low-pressure pump and the second low-pressure pump in accordance with an operation state of the internal combustion engine.

In addition, in the fuel supply apparatus for an internal combustion engine according to the present invention, when the fuel is supplied to the internal combustion engine solely by the low-pressure fuel supply means, the pump control means actuates the first low-pressure pump and does not actuate the second low-pressure pump. When the fuel is supplied to the internal combustion engine solely by the high-pressure fuel supply means, the pump control means does not actuate the first low-pressure pump and actuates the second low-pressure pump.

According to the present invention, the low-pressure fuel system supplying the fuel to the internal combustion engine by using the low-pressure fuel supply means and the high-pressure fuel system supplying the fuel to the internal combustion engine by using the high-pressure fuel supply means are independent of each other. Therefore, when the fuel is supplied to the internal combustion engine by the high-pressure fuel supply means and the low-pressure fuel supply means or solely by the low-pressure fuel supply means, propagation of pulsation generated from the high-pressure pump in the high-pressure fuel system to the low-pressure fuel supply means in the low-pressure fuel system is avoided. This is because the accumulator is interposed between the low-pressure fuel system and the high-pressure fuel system, so that pulsation generated from the high-pressure pump does not propagate to the low-pressure fuel system. Therefore, when the fuel is supplied to the internal combustion engine from the low-pressure fuel supply means in accordance with the operation state of the internal combustion engine, pulsation generated from the high-pressure pump does not propagate to the low-pressure fuel supply means.

Moreover, a fuel supply apparatus for an internal combustion engine according to the present invention includes: a low-pressure fuel system applying pressure to a fuel within an accumulator by using a first low-pressure pump and supplying the fuel to low-pressure fuel supply means through a first low-pressure pipe; a high-pressure fuel system applying pressure to the fuel in the accumulator by using a second low-pressure pump, applying further pressure through a second low-pressure pipe to the fuel by using a high-pressure pump driven by the internal combustion engine, and supplying the fuel to high-pressure fuel supply means; a connection pipe connecting between the first low-pressure pipe and the second low-pressure pipe; opening-closing means for opening and closing the connection pipe in accordance with an operation state of the internal combustion engine; and pump control means for controlling actuation of at least the first low-pressure pump and the second low-pressure pump in accordance with the operation state of the internal combustion engine.

In addition, in the fuel supply apparatus for an internal combustion engine according to the present invention, the opening-closing means is a check valve allowing solely flow-in of the fuel within the first low-pressure pipe, to which pressure has been applied, into the second low-pressure pipe.

In the fuel supply apparatus for an internal combustion engine according to the present invention, when the fuel is supplied to the internal combustion engine solely by the low-pressure fuel supply means, the pump control means actuates the first low-pressure pump and does not actuate the second low-pressure pump. When the fuel is supplied to the internal combustion engine solely by the high-pressure fuel supply means and a quantity of fuel supply to the internal combustion engine by the high-pressure fuel supply means is equal to or larger than a prescribed value, the pump control means actuates the first low-pressure pump and the second low-pressure pump.

In the fuel supply apparatus for an internal combustion engine according to the present invention, the opening-closing means is an open-close valve of which opening and closing is controlled by the pump control means.

In the fuel supply apparatus for an internal combustion engine according to the present invention, when the fuel is supplied to the internal combustion engine solely by the low-pressure fuel supply means, the pump control means closes the open-close valve, actuates the first low-pressure pump, and does not actuate the second low-pressure pump. When the fuel is supplied to the internal combustion engine solely by the high-pressure fuel supply means and a quantity of fuel supply to the internal combustion engine by the high-pressure fuel supply means is equal to or larger than a prescribed value, the pump control means opens the open-close valve and actuates the first low-pressure pump and the second low-pressure pump. When the fuel is supplied to the internal combustion engine by the low-pressure fuel supply means and the high-pressure fuel supply means, the pump control means actuates the first low-pressure pump and the second low-pressure pump, and when a quantity of fuel supply to the internal combustion engine by the high-pressure fuel supply means is equal to or larger than a prescribed value, the pump control means opens the open-close valve.

The fuel supply apparatus for an internal combustion engine according to the present invention further includes: first pressure regulation means for returning the fuel within the first low-pressure pipe to the accumulator when pressure in the first low-pressure pipe of the low-pressure fuel system is equal to or higher than a prescribed pressure; and second pressure regulation means for returning the fuel within the second low-pressure pipe to the accumulator when pressure in the second low-pressure pipe of the high-pressure fuel system is equal to or higher than a prescribed pressure. The prescribed pressure is identical in the first pressure regulation means and the second pressure regulation means.

According to the present invention, the low-pressure fuel system supplying the fuel to the internal combustion engine by using the low-pressure fuel supply means and the high-pressure fuel system supplying the fuel to the internal combustion engine by using the high-pressure fuel supply means operate independently of each other, in accordance with the operation state of the internal combustion engine. Specifically, when the fuel is supplied to the internal combustion engine at least solely by the low-pressure fuel supply means, flow-in of the fuel within the second low-pressure fuel pipe into the first low-pressure pipe through the connection pipe is avoided by means of the check valve serving as the opening-closing means and allowing solely flow-in of the fuel within the first low-pressure pipe, to which pressure has been applied, into the second low-pressure pipe, or by closing the open-close valve. Therefore, pulsation generated from the high-pressure pump in the high-pressure fuel system does not propagate to the low-pressure fuel supply means in the low-pressure fuel system. In addition, when the fuel is supplied to the internal combustion engine by the high-pressure fuel supply means and the low-pressure fuel supply means, flow-in of the fuel within the second low-pressure fuel pipe into the first low-pressure pipe through the connection pipe is avoided by means of the check valve. Alternatively, flow-in of the fuel within the second low-pressure fuel pipe into the first low-pressure pipe through the connection pipe is suppressed by means of the open-close valve that opens when the quantity of fuel supply to the internal combustion engine by the high-pressure fuel supply means is equal to or larger than the prescribed value, that is, by means of the open-close valve that closes when the quantity of fuel supply to the internal combustion engine by the high-pressure fuel supply means is smaller than the prescribed value. Therefore, propagation of pulsation generated from the high-pressure pump in the high-pressure fuel system to the low-pressure fuel supply means in the low-pressure fuel system is avoided or suppressed.

The fuel supply apparatus for the internal combustion engine according to the present invention attains an effect to mitigate influence by pulsation generated from the high-pressure pump on the quantity of fuel supply to the internal combustion engine, because propagation of pulsation generated from the high-pressure pump in the high-pressure fuel system to the low-pressure fuel supply means in the low-pressure fuel system is avoided when the fuel is supplied to the internal combustion engine only by the low-pressure fuel supply means, and propagation of pulsation generated from the high-pressure pump in the high-pressure fuel system to the low-pressure fuel supply means in the low-pressure fuel system can be avoided or suppressed when the fuel is supplied to the internal combustion engine by the high-pressure fuel supply means and the low-pressure fuel supply means.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The present invention will be described hereinafter in detail with reference to the drawings. It is noted that embodiments do not limit the present invention. It is also noted that constituent features in the embodiments described below includes elements readily conceived by a person skilled in the art or substantially the same elements. Here, a fuel supply apparatus for an internal combustion engine described below supplies a fuel to an engine serving as the internal combustion engine such as a gasoline engine and a diesel engine incorporated in a vehicle such as a passenger car, a truck, or the like. In the embodiments below, a fuel supply apparatus in an in-line 4-cylinder engine having four cylinders provided in series will be described, however, the present invention is not limited thereto. The present invention may be used in a V-type 6-cylinder engine including two cylinder groups each consisting of three cylinders, an in-line 6-cylinder engine, a V-type 8-cylinder engine including two cylinder groups each consisting of four cylinders, or the like.

First Embodiment

Figure 1:
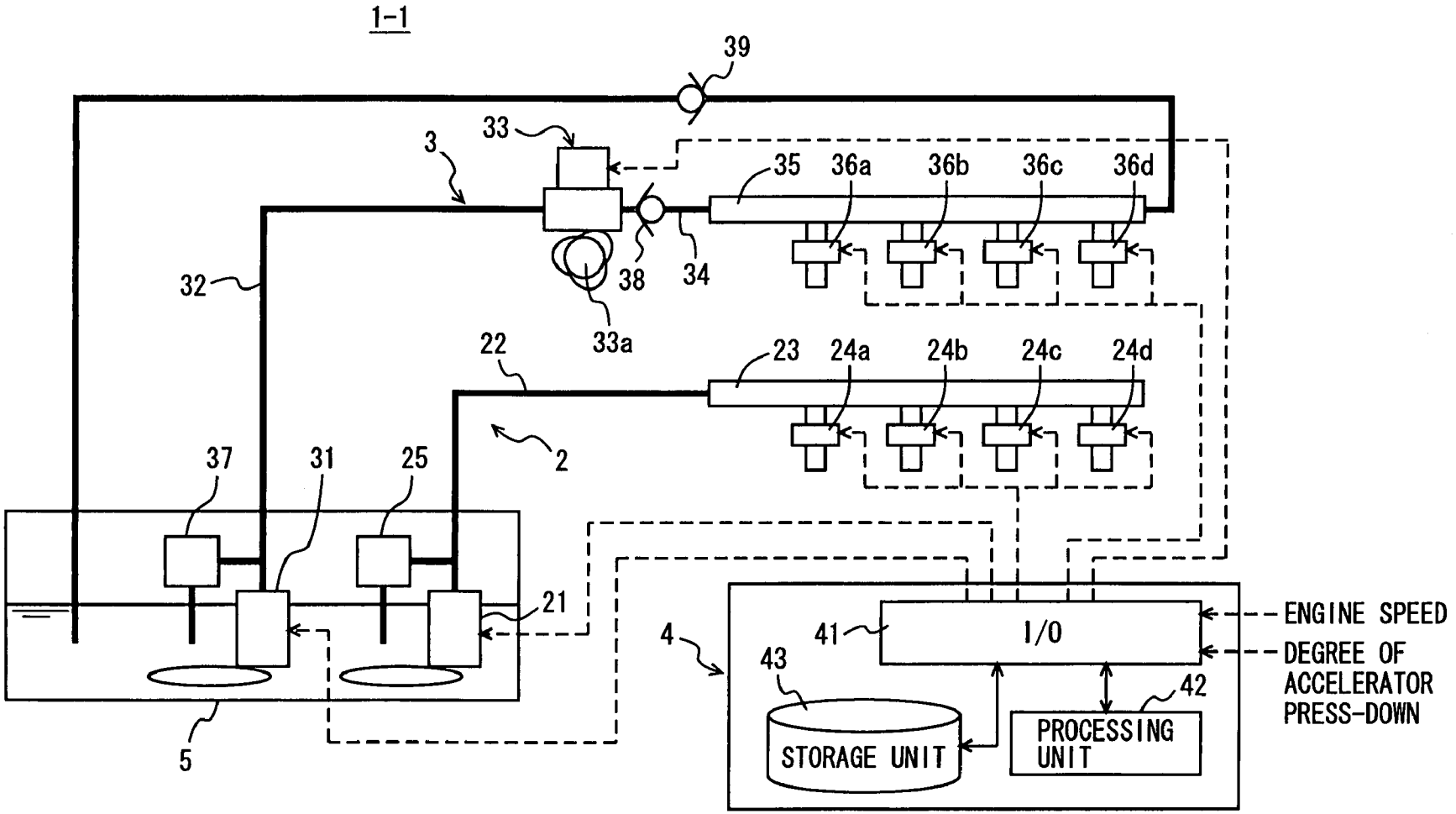
FIG. 1 illustrates a configuration example of a fuel supply apparatus for an internal combustion engine according to a first embodiment.
Figure 2:
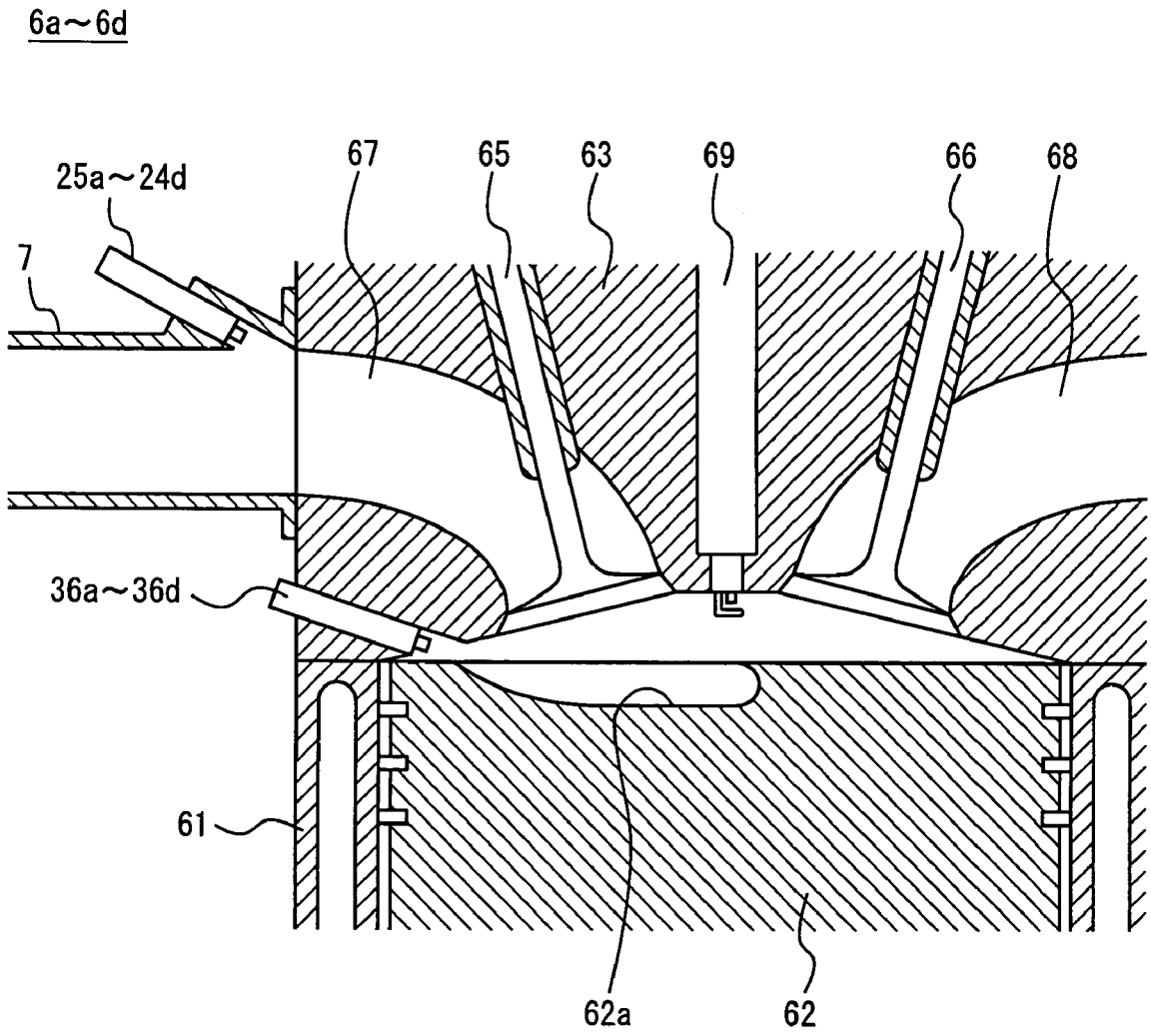
FIG. 2 illustrates a configuration example of a cylinder of the internal combustion engine according to the present invention.

FIG. 1 illustrates a configuration example of the fuel supply apparatus for the internal combustion engine according to a first embodiment. FIG. 2 illustrates a configuration example of a cylinder of the internal combustion engine according to the present invention. As shown in FIG. 1, a fuel supply apparatus 1-1 according to the first embodiment includes a low-pressure fuel system 2, a high-pressure fuel system 3, an ECU 4, and a fuel tank 5 serving as an accumulator for storing the fuel.

Low-pressure fuel system 2 is constituted of a first low-pressure pump 21, a first low-pressure pipe 22, and a low-pressure delivery pipe 23 and port fuel injection valves 24*a* to 24*d* implementing the low-pressure fuel supply means. A first regulator 25 attains a function as first pressure regulation means for returning a part of the low-pressure fuel discharged from first low-pressure pump 21 to first low-pressure pipe 22 to fuel tank 5 when the pressure of the low-pressure fuel in first low-pressure pipe 22 of low-pressure fuel system 2 becomes higher than a prescribed pressure (low pressure). With this first regulator, the pressure within first low-pressure pipe 22, that is, the pressure of the low-pressure fuel to be supplied to port fuel injection valves 24*a* to 24*d* can be held to a constant value (low pressure).

First low-pressure pump 21 suctions the fuel within fuel tank 5 through a not-shown strainer and a not-shown filter, applies pressure to the suctioned fuel up to the prescribed pressure (low pressure), and discharges the fuel to first low-pressure pipe 22. First low-pressure pump 21 is of an electric type including a not-shown motor. ECU 4 which will be described later drives the motor, so as to control actuation of first low-pressure pump 21.

The low-pressure fuel to which pressure has been applied by first low-pressure pump 21 passes through first low-pressure pipe 22, and is delivered to low-pressure delivery pipe 23 implementing the low-pressure fuel supply means. Low-pressure delivery pipe 23 is connected to port fuel injection valves 24*a* to 24*d*. Accordingly, the low-pressure fuel delivered from first low-pressure pump 21 through first low-pressure pipe 22 is supplied to each port fuel injection valve 24*a* to 24*d* through low-pressure delivery pipe 23.

Port fuel injection valves 24*a* to 24*d* implementing the low-pressure fuel supply means are provided corresponding to cylinders 6*a* to 6*d* of the in-line 4-cylinder engine respectively. Port fuel injection valves 24*a* to 24*d* are electromagnetic valves, and injection timing or a fuel supply quantity based on a time period during which the electromagnetic valve is electrified, that is, an injection quantity, is controlled by ECU 4 which will be described later. For example, in a 6-cylinder engine, the low-pressure fuel supply means has one or more low-pressure delivery pipe and six port fuel injection valves.

High-pressure fuel system 3 is constituted of a second low-pressure pump 31, a second low-pressure pipe 32, a high-pressure pump 33, a high-pressure pipe 34, and a high-pressure delivery pipe 35 and in-cylinder fuel injection valves 36*a* to 36*d* implementing the high-pressure fuel supply means. A second regulator 37 attains a function as second pressure regulation means for returning a part of the low-pressure fuel discharged from second low-pressure pump 31 to second low-pressure pipe 32 to fuel tank 5 when the pressure of the low-pressure fuel in second low-pressure pipe 32 of high-pressure fuel system 3 becomes higher than a prescribed pressure (low pressure). With this second regulator 37, the pressure within second low-pressure pipe 32, that is, the pressure of the low-pressure fuel to be supplied to high-pressure pump 33 can be held to a constant value. Here, the prescribed pressure when the low-pressure fuel is returned to fuel tank 5 by first regulator 25 and second regulator 37 may be the same or different in the first embodiment. A check valve 38 attains a function to prevent the high-pressure fuel supplied to high-pressure delivery pipe 35 and in-cylinder fuel injection valves 36*a* to 36*d* implementing the high-pressure fuel supply means from returning to the high-pressure pump. A relief valve 39 attains a function to return a part of the high-pressure fuel within high-pressure delivery pipe 35 to fuel tank 5 and to maintain the pressure of the high-pressure fuel within high-pressure delivery pipe 35 and in-cylinder fuel injection valves 36*a* to 36*d* to a constant value (high pressure) when the pressure of the high-pressure fuel supplied to high-pressure delivery pipe 35 and in-cylinder fuel injection valves 36*a* to 36*d* becomes higher than a prescribed pressure (high pressure).

Second low-pressure pump 31 suctions the fuel within fuel tank 5 through a not-shown strainer and a not-shown filter, applies pressure to the suctioned fuel up to the prescribed pressure (low pressure), and discharges the fuel to second low-pressure pipe 32. Second low-pressure pump 31 is of an electric type including a now-shown motor. ECU 4 which will be described later drives the motor, so as to control actuation of second low-pressure pump 31.

The low-pressure fuel to which pressure has been applied by second low-pressure pump 31 passes through second low-pressure pipe 32, and is delivered to high-pressure pump 33. Here, high-pressure pump 33 operates in the following manner. A cam 33*a* for the pump coupled to a crankshaft of a not-shown engine rotates, so as to cause a not-shown plunger within high-pressure pump 33 to carry out reciprocating motion. As a result of the reciprocating motion of the plunger, the low-pressure fuel within second low-pressure pipe 32, that is, the fuel to which pressure has been applied by second low-pressure pump 31 in high-pressure fuel system 3, is suctioned into a not-shown pressurizing chamber, in which further pressure is applied to the suctioned low-pressure fuel up to a prescribed pressure (high pressure). Resultant fuel is thus discharged to high-pressure pipe 34. In other words, high-pressure pump 33 is driven in accordance with the operation state of the engine serving as the internal combustion engine. High-pressure pump 33 includes a not-shown metering valve of which degree of opening is controlled by ECU 4 which will be described later.

The high-pressure fuel to which further pressure has been applied by high-pressure pump 33 passes through check valve 38 and high-pressure pipe 34, and is delivered to high-pressure delivery pipe 35 implementing the high-pressure fuel supply means. High-pressure delivery pipe 35 is connected to in-cylinder fuel injection valves 36*a* to 36*d*. Accordingly, the high-pressure fuel delivered from high-pressure pump 33 through high-pressure pipe 34 is supplied to each in-cylinder fuel injection valve 36*a* to 36*d* through high-pressure delivery pipe 35.

In-cylinder fuel injection valves 36*a* to 36*d* implementing the high-pressure fuel supply means are provided corresponding to cylinders 6*a* to 6*d* of the in-line 4-cylinder engine respectively. In-cylinder fuel injection valves 36*a* to 36*a* are electromagnetic valves, and injection timing or a fuel supply quantity based on a time period during which the electromagnetic valve is electrified, that is, an injection quantity, is controlled by ECU 4 which will be described later. For example, in a 6-cylinder engine, the high-pressure fuel supply means has one or more high-pressure delivery pipe and six in-cylinder fuel injection valves.

As described above, in fuel supply apparatus 1-1 for the internal combustion engine according to the first embodiment, low-pressure fuel system 2 and high-pressure fuel system 3 are independent of each other. In other words, low-pressure fuel system 2 supplying the fuel to the internal combustion engine by using port fuel injection valves 24*a* to 24*d* implementing the low-pressure fuel supply means and high-pressure fuel system 3 supplying the fuel to the internal combustion engine by using in-cylinder fuel injection valves 36*a* to 36*d* implementing the high-pressure fuel supply means are independent of each other. Accordingly, first low-pressure pump 21 supplying the fuel to port fuel injection valves 24*a* to 24*d* implementing the low-pressure fuel supply means should be implemented by a pump attaining a discharge flow rate allowing a maximum quantity of injection of fuel to the internal combustion engine through port fuel injection valves 24*a* to 24*d*, that is, a maximum quantity of fuel supply to the internal combustion engine, in accordance with the operation state of the internal combustion engine. Meanwhile, second low-pressure pump 31 supplying the fuel to in-cylinder fuel injection valves 36*a* to 36*d* implementing the high-pressure fuel supply means should be implemented by a pump based on high-pressure pump 33 attaining a discharge flow rate allowing a maximum quantity of injection of fuel to the internal combustion engine through in-cylinder fuel injection valves 36*a* to 36*d*, that is, a maximum quantity of fuel supply to the internal combustion engine, in accordance with the operation state of the internal combustion engine. Therefore, if the discharge flow rate of the low-pressure pump in a conventional fuel supply apparatus for an internal combustion engine is assumed as 1.0, for example, first low-pressure pump 21 is implemented by a low-pressure pump attaining a discharge flow rate of approximately 0.8, and second low-pressure pump 31 is implemented by a low-pressure pump attaining a discharge flow rate of approximately 1.0.

As shown in FIG. 2, each cylinder 6*a* to 6*d* of the engine is constituted of a cylinder block 61, a piston 62, a cylinder head 63 fixed to cylinder block 61, a combustion chamber formed between piston 62 and cylinder head 63, an intake valve 65, an exhaust valve 66, an intake port 67, an exhaust port 68, and a spark plug 69. Port fuel injection valves 24*a* to 24*d* implementing the low-pressure fuel supply means are provided so as to be able to inject the fuel into an intake manifold 7 connected to intake port 67. In addition, in-cylinder fuel injection valves 36*a* to 36*d* implementing the high-pressure fuel supply means are fixed to cylinder head 63, and provided so as to be able to directly inject the fuel into the combustion chamber. A concave portion 62*a* attains a function to guide the fuel injected from in-cylinder fuel injection valves 36*a* to 36*d* to the vicinity of spark plug 69. Port fuel injection valves 24*a* to 24*d* may inject the fuel into a not-shown surge tank provided upstream of intake manifold 7 or directly into intake port 67, so as to supply the fuel to the engine.

ECU 4 attains a function as the pump control means. As shown in FIG. 1, ECU 4 receives an engine speed, a degree of accelerator press-down L, a quantity of suctioned air or the like as an input signal from sensors attached to several positions of the engine, such as a not-shown angle sensor attached to a not-shown crankshaft for detecting an engine speed, a not-shown accelerator press-down degree sensor for detecting the degree of accelerator press-down, a not-shown air flow meter for detecting a quantity of air suctioned into the engine, or the like. Based on the input signal and a variety of maps stored in a storage unit 43, ECU 4 supplies an output signal such as an injection signal for injection control of port fuel injection valves 24*a* to 24*d* and in-cylinder fuel injection valves 36*a* to 36*d*, an opening-degree signal for valve-opening degree control of a not-shown throttle valve, an ignition signal for ignition control of spark plug 69, an actuation signal for actuation control of first low-pressure pump 21 and second low-pressure pump 31, an opening-degree signal for valve-opening degree control of a not-shown metering valve of high-pressure pump 33, or the like.

Specifically, ECU 4 is constituted of an input/output port (I/O) 41 for input and output of the input signal or the output signal, a processing unit 42 calculating injection timing or an injection quantity of port fuel injection valves 24*a* to 24*d* and in-cylinder fuel injection valves 36*a* to 36*d*, and storage unit 43 storing the map described above or the like. A manner of operation of fuel supply apparatus 1-1 for the internal combustion engine according to the first embodiment may be realized by dedicated hardware. Processing unit 42 is implemented by a memory and a CPU (Central Processing Unit), and may realize the manner of operation of fuel supply apparatus 1-1 for the internal combustion engine according to the first embodiment by loading a program based on the manner of operation of fuel supply apparatus 1-1 for the internal combustion engine according to the first embodiment in the memory for execution. Storage unit 43 may be implemented by a non-volatile memory such as a flash memory, a read-only volatile memory such as an ROM (Read Only Memory), a readable and writable volatile memory such as an RAM (Random Access Memory), or a combination thereof.

Figure 3:
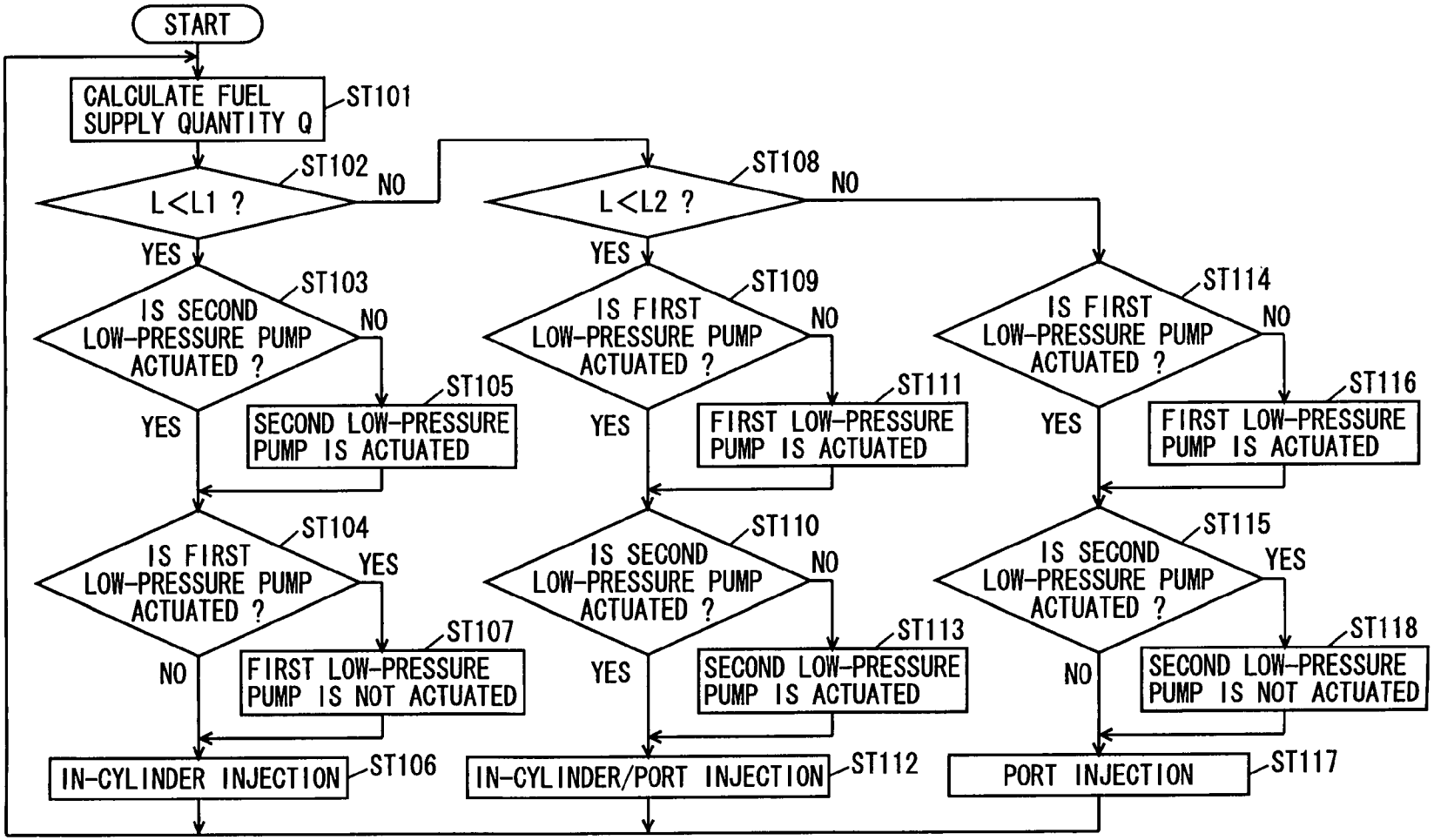
FIG. 3 illustrates an operation flow in the fuel supply apparatus for the internal combustion engine according to the first embodiment.
Figure 4:
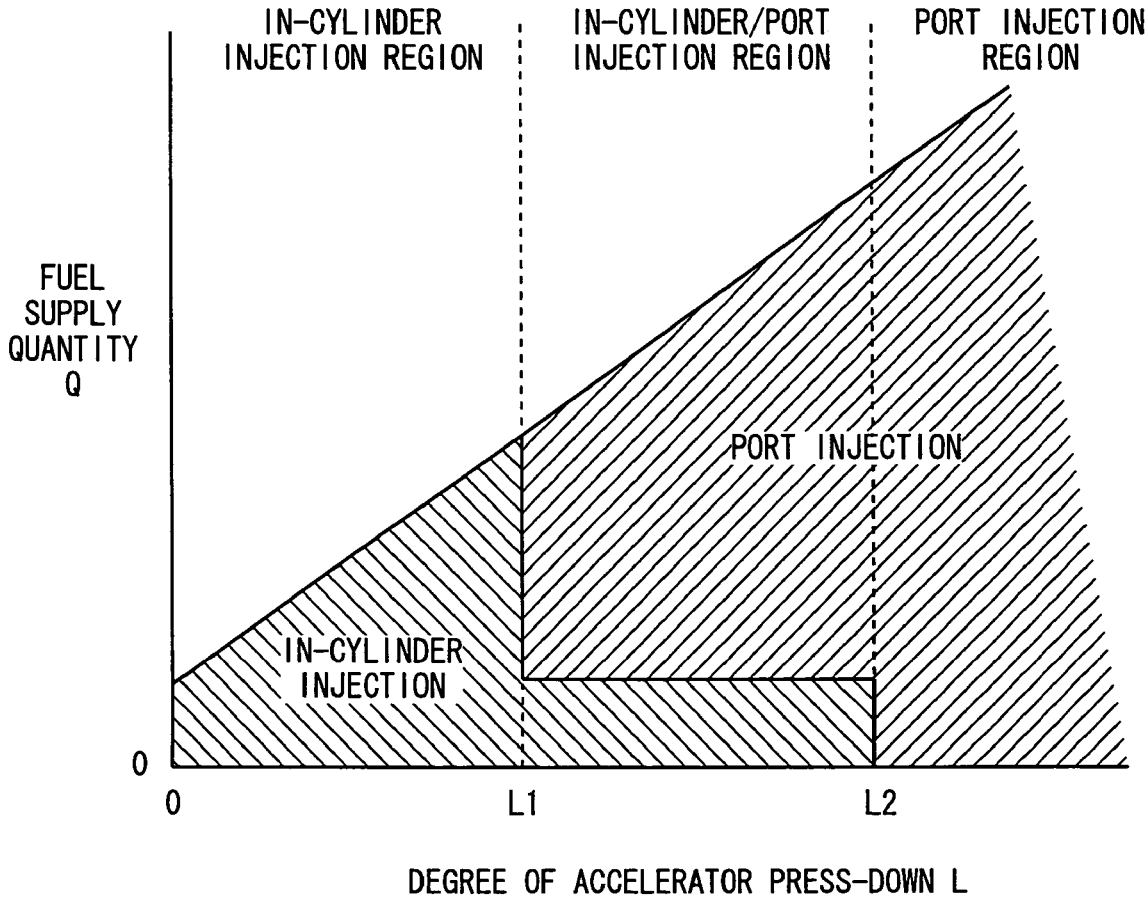
FIG. 4 illustrates a configuration example of a map of a fuel supply quantity and a degree of accelerator press-down.

An operation of fuel supply apparatus 1-1 of the internal combustion engine according to the first embodiment will now be described. FIG. 3 illustrates an operation flow in the fuel supply apparatus for the internal combustion engine according to the first embodiment. FIG. 4 illustrates a configuration example of a map of a fuel supply quantity Q and degree of accelerator press-down L. Initially, as shown in FIG. 3, processing unit 42 of ECU 4 calculates quantity Q of fuel to be supplied to the engine (step ST101). Fuel supply quantity Q is determined based on a not-shown map of the engine speed and degree of accelerator press-down L stored in storage unit 43 and on input signals indicating the engine speed and degree of accelerator press-down L input from the engine to ECU 4.

Thereafter, processing unit 42 determines whether degree of accelerator press-down L is smaller than a prescribed value L1 (step ST102). When degree of accelerator press-down L is smaller than prescribed value L1, ECU 4 serving as the pump control means determines that the injection region for supplying the fuel to the engine is the injection region where only in-cylinder fuel injection valves 36*a* to 36*d* implementing the high-pressure fuel supply means are used, that is, the in-cylinder injection region, based on the operation state of the engine serving as the internal combustion engine, as shown in FIG. 4. Thereafter, processing unit 42 determines whether second low-pressure pump 31 is actuated or not (step ST103).

If processing unit 42 determines that second low-pressure pump 31 is actuated, processing unit 42 determines whether first low-pressure pump 21 is actuated or not (step ST104). Here, if processing unit 42 determines that second low-pressure pump 31 is not actuated, processing unit 42 outputs an actuation signal to second low-pressure pump 31, so as to actuate second low-pressure pump 31 (step ST105).

If processing unit 42 determines that first low-pressure pump 21 is not actuated, in order to supply the fuel satisfying fuel supply quantity Q to the engine, processing unit 42 outputs an injection signal indicating injection timing and injection quantity to in-cylinder fuel injection valves 36*a* to 36*a*, so as to cause these fuel injection valves to perform in-cylinder injection (step ST106). If processing unit 42 determines that first low-pressure pump 21 is actuated, processing unit 42 stops the actuation signal being output to first low-pressure pump 21, so as not to actuate low-pressure pump 21 (step ST107). Therefore, when the fuel is supplied to the engine serving as the internal combustion engine only by the in-cylinder fuel injection valves 36*a* to 36*d* implementing the high-pressure fuel supply means, first low-pressure pump 21 is not actuated. In this manner, as compared with an example in which first low-pressure pump 21 and second low-pressure pump 31 are actuated, power consumption can be reduced.

In-cylinder fuel injection valves 36*a* to 36*d* serving as the high-pressure fuel supply means inject the high-pressure fuel to the combustion chamber only once in a latter stage of compression stroke of each cylinder 6*a* to 6*d*, for example. The injected high-pressure fuel moves along a surface of concave portion 62*a* of piston 62 shown in FIG. 2, and moves from a space below spark plug 69 toward cylinder head 63. When intake valve 65 is opened, the fuel is mixed with the air that has been introduced in the combustion chamber in advance, so as to form an air-fuel mixture. The air-fuel mixture is ignited by ignition of spark plug 69 in response to an ignition signal output from processing unit 42 of ECU 4, whereby rotation force is applied to the crankshaft of the not-shown engine.

Thereafter, if processing unit 42 determines that degree of accelerator press-down L is not smaller than prescribed value L1, processing unit 42 determines whether degree of accelerator press-down L is smaller than a prescribed value L2 (step ST108). If degree of accelerator press-down L is smaller than prescribed value L2, ECU 4 determines that the injection region for supplying the fuel to the engine is the injection region where in-cylinder fuel injection valves 36*a* to 36*d* implementing the high-pressure fuel supply means and port fuel injection valves 24*a* to 24*d* implementing the low-pressure fuel supply means are used, that is, the in-cylinder/port injection region, based on the operation state of the engine serving as the internal combustion engine, as shown in FIG. 4. Then, processing unit 42 determines whether first low-pressure pump 21 is actuated or not (step ST109).

If processing unit 42 determines that first low-pressure pump 21 is actuated, processing unit 42 determines whether second low-pressure pump 31 is actuated or not (step ST110). Here, if processing unit 42 determines that first low-pressure pump 21 is not actuated, processing unit 42 outputs an actuation signal to first low-pressure pump 21, so as to actuate first low-pressure pump 21 (step ST111).

If processing unit 42 determines that second low-pressure pump 31 is actuated, in order to supply the fuel satisfying fuel supply quantity Q to the engine, processing unit 42 outputs an injection signal indicating injection timing and injection quantity to in-cylinder fuel injection valves 36*a* to 36*a* and port fuel injection valves 24*a* to 24*d*, so as to cause these fuel injection valves to perform in-cylinder/port injection (step ST112). If processing unit 42 determines that second low-pressure pump 31 is not actuated, processing unit 42 outputs the actuation signal to second low-pressure pump 31, so as to actuate second low-pressure pump 31 (step ST113).

For example, as shown in FIG. 2, port fuel injection valves 24*a* to 24*d* serving as the low-pressure fuel supply means inject the low-pressure fuel into intake manifold 7 only once at an initial stage of intake stroke of each cylinder 6*a* to 6*d*. The injected low-pressure fuel is mixed with the air within intake manifold 7 to form an air-fuel mixture, and the air-fuel mixture is introduced into the combustion chamber through intake port 67. Then, in-cylinder fuel injection valves 36*a* to 36*d* serving as the high-pressure fuel supply means inject the high-pressure fuel into the combustion chamber only once in the latter stage of the compression stroke of each cylinder 6*a* to 6*d*. The injected high-pressure fuel moves along the surface of concave portion 62*a* of piston 62, and moves from a space below spark plug 69 toward cylinder head 63. When intake valve 65 is opened, the fuel is further mixed with the air-fuel mixture that has been introduced in the combustion chamber in advance, so as to form an air-fuel mixture that can be ignited by spark plug 69. The air-fuel mixture is ignited by ignition of spark plug 69 in response to an ignition signal output from processing unit 42 of ECU 4, whereby rotation force is applied to the crankshaft of the not-shown engine.

Thereafter, if processing unit 42 determines that degree of accelerator press-down L is not smaller than prescribed value L2, ECU 4 determines that the injection region of the fuel is the injection region where only port fuel injection valves 24*a* to 24*d* implementing the low-pressure fuel supply means are used, that is, the port injection region, based on the operation state of the engine serving as the internal combustion engine, as shown in FIG. 4. Thereafter, processing unit 42 determines whether first low-pressure pump 21 is actuated or not (step ST114).

If processing unit 42 determines that first low-pressure pump 21 is actuated, processing unit 42 determines whether second low-pressure pump 31 is actuated or not (step ST115). Here, if processing unit 42 determines that first low-pressure pump 21 is not actuated, processing unit 42 outputs an actuation signal to first low-pressure pump 21, so as to actuate first low-pressure pump 21 (step ST116).

If processing unit 42 determines that second low-pressure pump 31 is not actuated, in order to supply the fuel satisfying fuel supply quantity Q to the engine, processing unit 42 outputs an injection signal indicating injection timing and injection quantity to port fuel injection valves 24*a* to 24*a*, so as to cause these fuel injection valves to perform port injection (step ST117). If processing unit 42 determines that second low-pressure pump 31 is actuated, processing unit 42 stops the actuation signal being output to second low-pressure pump 31, so as not to actuate second low-pressure pump 31 (step ST118). Therefore, when the fuel is supplied to the engine serving as the internal combustion engine only by port fuel injection valves 24*a* to 24*d* implementing the low-pressure fuel supply means, second low-pressure pump 31 is not actuated. In this manner, as compared with the example in which first low-pressure pump 21 and second low-pressure pump 31 are actuated, power consumption can be reduced.

For example, as shown in FIG. 2, port fuel injection valves 24*a* to 24*d* serving as the low-pressure fuel supply means inject the fuel into intake manifold 7 only once at an initial stage of the intake stroke of each cylinder 6*a* to 6*d*. The injected low-pressure fuel is mixed with the air within intake manifold 7 to form an air-fuel mixture, and the air-fuel mixture is introduced into the combustion chamber through intake port 67. The air-fuel mixture is ignited by ignition of spark plug 69 in response to an ignition signal output from processing unit 42 of ECU 4, whereby rotation force is applied to the crankshaft of the not-shown engine.

As described above, when the fuel is supplied to the engine serving as the internal combustion engine by in-cylinder fuel injection valves 36*a* to 36*d* and port fuel injection valves 24*a* to 24*d*, that is, when in-cylinder/port injection is performed, pulsation generated from high-pressure pump 33 of high-pressure fuel system 3 does not propagate to low-pressure delivery pipe 23 and port fuel injection valves 24*a* to 24*d* implementing the low-pressure fuel supply means of low-pressure fuel system 2, because fuel tank 5 serving as an accumulator is interposed between low-pressure fuel system 2 and high-pressure fuel system 3. In addition, when the fuel is supplied to the engine only by port fuel injection valves 24*a* to 24*d*, that is, when port injection is performed as well, pulsation generated from high-pressure pump 33 of high-pressure fuel system 3 does not propagate to low-pressure delivery pipe 23 and port fuel injection valves 24*a* to 24*d* implementing the low-pressure fuel supply means of low-pressure fuel system 2. Therefore, when the fuel is injected to the engine from port fuel injection valves 24*a* to 24*d* in accordance with the operation state of the engine, influence by pulsation generated from high-pressure pump 33 on quantity Q of fuel to be supplied to the engine can be mitigated.

Second Embodiment

High-pressure pump 33 in high-pressure fuel system 3 operates in the following manner. Cam 33*a* for the pump rotates, so as to lower a not-shown plunger. Then, a volume in a not-shown pressurizing chamber is increased, and the low-pressure fuel within second low-pressure pipe 32 is suctioned. Thereafter, a not-shown metering valve is closed by ECU 4, the plunger is elevated, and a volume in the pressurizing chamber is decreased. Pressure is then applied to the low-pressure fuel within the pressurizing chamber, and resultant fuel is discharged to high-pressure pipe 34 as the high-pressure fuel. That is, a time period during which the low-pressure fuel within second low-pressure pipe 32 is suctioned by high-pressure pump 33 is half the time period of operation of high-pressure pump 33. Therefore, the discharge flow rate required in second low-pressure pump 31 supplying the low-pressure fuel to high-pressure pump 33 is twice the discharge flow rate (per unit time) of high-pressure pump 33, because second low-pressure pump 31 continuously delivers the low-pressure fuel into second low-pressure pipe 32. In addition, a rate of flow-in of the low-pressure fuel into the not-shown pressurizing chamber of high-pressure pump 33 is increased from 0 m/s in response to opening of the not-shown metering valve by a prescribed valve opening degree. Therefore, the discharge flow rate required in second low-pressure pump 31 is twice or more the discharge flow rate (per unit time) of high-pressure pump 33. In particular, high-pressure pump 33 is driven in accordance with the operation state of the engine serving as the internal combustion engine. Therefore, if the engine speed is high, the discharge flow rate required in second low-pressure pump 31 is considerably increased. In view of these facts, if the discharge flow rate of second low-pressure pump 31 is small, the pressure of the low-pressure fuel within second low-pressure pipe 32 is lowered, and insufficient suction in high-pressure pump 33 may take place.

In addition, in the conventional fuel supply apparatus for the internal combustion engine, a pump attaining a high discharge flow rate and a high discharge pressure has been employed as the low-pressure pump, in order to suppress occurrence of insufficient suction in the high-pressure pump. In the conventional fuel supply apparatus for the internal combustion engine, however, the low-pressure pump should constantly be actuated, and therefore, reduction in power consumption in the low-pressure pump has been difficult. According to fuel supply apparatuses 1-2 and 1-3 in a second embodiment and a third embodiment which will be described later, even if a discharge flow rate of the low-pressure pump supplying the low-pressure fuel to high-pressure pump 33 is small, occurrence of insufficient suction in high-pressure pump 33 can be suppressed and power consumption can be reduced.

Figure 5:
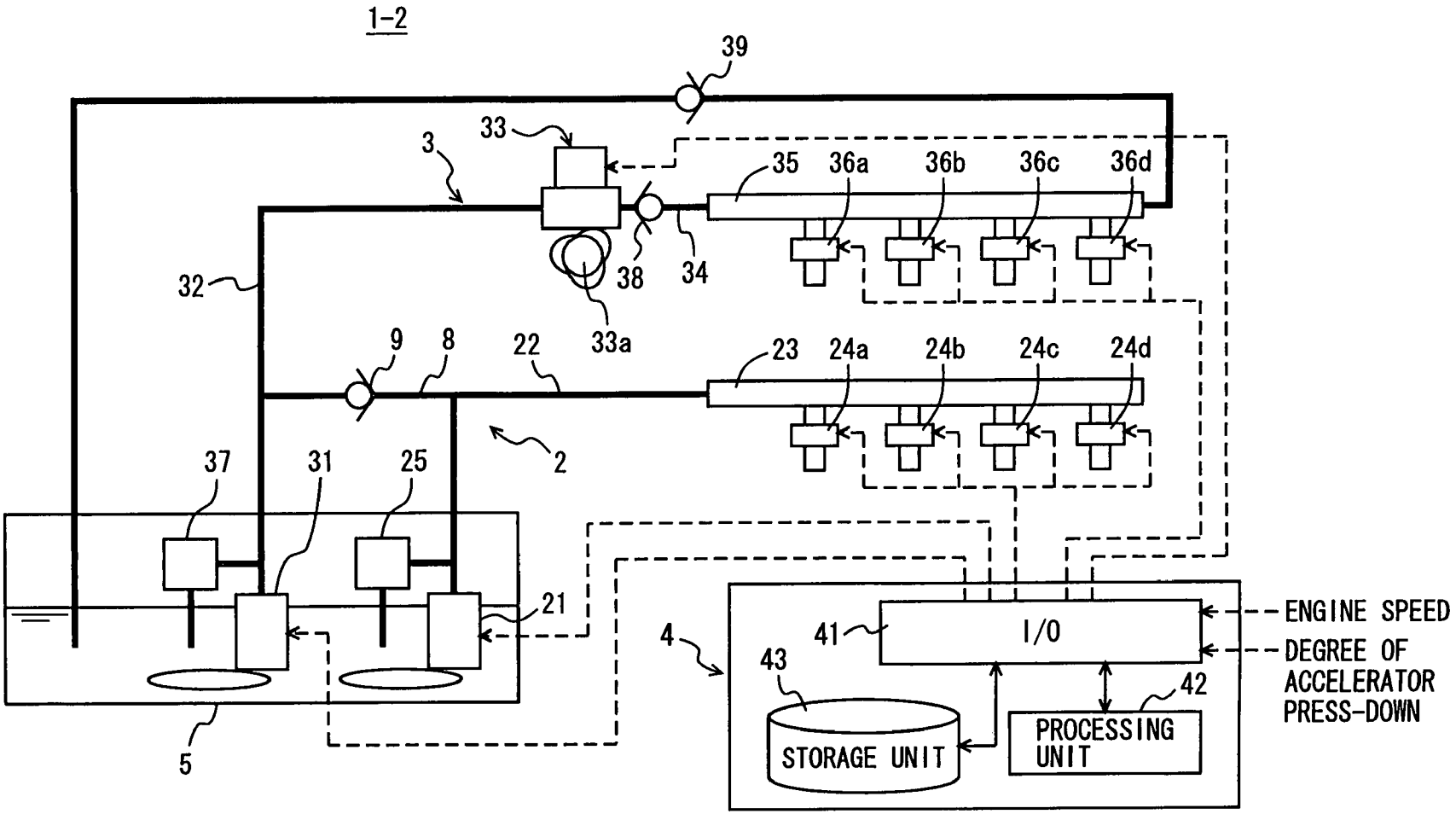
FIG. 5 illustrates a configuration example of a fuel supply apparatus for an internal combustion engine according to a second embodiment.

FIG. 5 illustrates a configuration example of the fuel supply apparatus according to the second embodiment. Fuel supply apparatus 1-2 shown in FIG. 5 is different from fuel supply apparatus 1-1 shown in FIG. 1 in that a connection pipe 8 connecting between low-pressure fuel system 2 and high-pressure fuel system 3 is provided and a check valve 9 is provided in connection pipe 8. As a basic configuration of fuel supply apparatus 1-2 shown in FIG. 5 is similar to that of fuel supply apparatus 1-1 shown in FIG. 1, description thereof will not be repeated.

Connection pipe 8 connecting between first low-pressure pipe 22 delivering the low-pressure fuel from first low-pressure pump 21 to low-pressure delivery pipe 23 implementing the low-pressure fuel supply means and second low-pressure pipe 32 delivering the low-pressure fuel from second low-pressure pump 31 to high-pressure pump 33 is provided between low-pressure fuel system 2 and high-pressure fuel system 3. In connection pipe 8, check valve 9 serving as the opening-closing means for allowing only flow-in of the low-pressure fuel within first low-pressure pipe 22, to which pressure has been applied by first low-pressure pump 21, into second low-pressure pipe 32 is provided. That is, check valve 9 in connection pipe 8 serves to open and close connection pipe 8. Check valve 9 prevents the low-pressure fuel within second low-pressure pipe 32, to which pressure has been applied by second low-pressure pump 31, from flowing into first low-pressure pipe 22.

Here, first low-pressure pump 21 supplying the fuel to port fuel injection valves 24*a* to 24*d* implementing the low-pressure fuel supply means may be implemented by a pump attaining a discharge flow rate allowing a maximum quantity of injection of fuel to the internal combustion engine through port fuel injection valves 24*a* to 24*d*, that is, a maximum quantity of fuel supply to the internal combustion engine, in accordance with the operation state of the internal combustion engine. Meanwhile, second low-pressure pump 31 supplying the fuel to in-cylinder fuel injection valves 36*a* to 36*d* implementing the high-pressure fuel supply means may be implemented by high-pressure pump 33 attaining a discharge flow rate smaller than that of the high-pressure pump attaining a discharge flow rate allowing a maximum quantity of injection of fuel to the internal combustion engine through port fuel injection valves 24*a* to 24*d*, that is, a maximum quantity of fuel supply to the internal combustion engine, in accordance with the operation state of the internal combustion engine, by means of a manner of operation of the fuel supply apparatus for the internal combustion engine according to the second embodiment which will be described later. Therefore, if the discharge flow rate of the low-pressure pump in the conventional fuel supply apparatus for the internal combustion engine is assumed as 1.0, for example, first low-pressure pump 21 is implemented by a low-pressure pump attaining a discharge flow rate of approximately 0.8, and second low-pressure pump 31 is implemented also by a low-pressure pump attaining a discharge flow rate of approximately 0.8.

Here, in the second embodiment, the prescribed pressure when the low-pressure fuel is returned to fuel tank 5 by first regulator 25 and second regulator 37 is assumed as the same. Accordingly, when the pressure of the low-pressure fuel within second low-pressure pipe 32 of high-pressure fuel system 3 is lowered, the low-pressure fuel within first low-pressure pipe 22 of low-pressure fuel system 2, of which pressure is maintained to a constant value (low pressure), can reliably be supplied to second low-pressure pipe 32 from check valve 9 through connection pipe 8.

Figure 6:
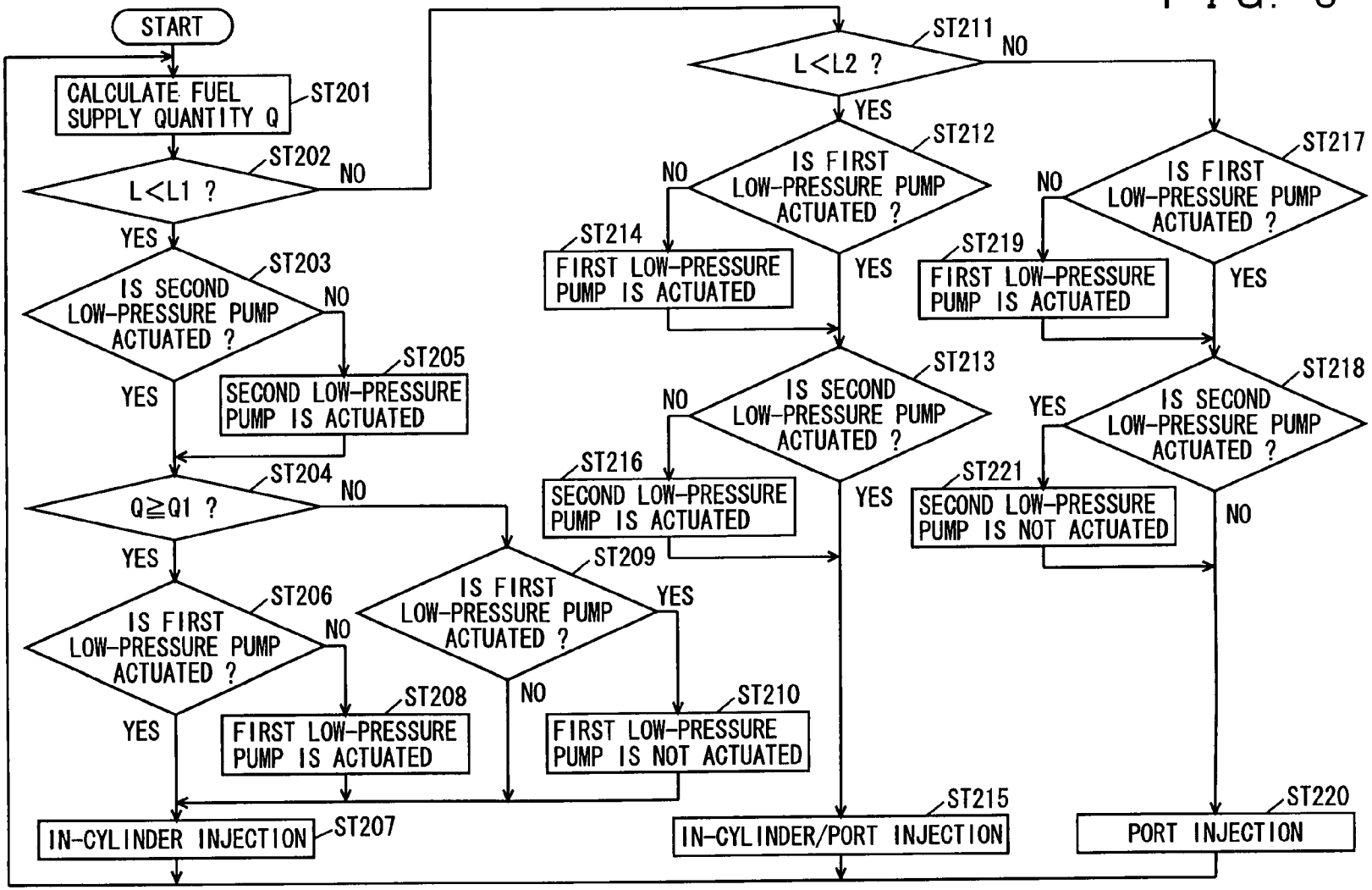
FIG. 6 illustrates an operation flow in the fuel supply apparatus for the internal combustion engine according to the second embodiment.

A manner of operation of fuel supply apparatus 1-2 for the internal combustion engine according to the second embodiment will now be described. FIG. 6 illustrates an operation flow in the fuel supply apparatus for the internal combustion engine according to the second embodiment. As the manner of operation of fuel supply apparatus 1-2 shown in FIG. 6 is basically the same as that of fuel supply apparatus 1-1 shown in FIG. 3, description thereof will be simplified. Initially, as shown in FIG. 6, processing unit 42 of ECU 4 calculates quantity Q of fuel to be supplied to the engine (step ST201). Thereafter, processing unit 42 determines whether degree of accelerator press-down L is smaller than prescribed value L1 (step ST202). When degree of accelerator press-down L is smaller than prescribed value L1, ECU 4 serving as the pump control means determines the injection region as the in-cylinder injection region, based on the operation state of the engine serving as the internal combustion engine, as shown in FIG. 4. Thereafter, processing unit 42 determines whether second low-pressure pump 31 is actuated or not (step ST203).

If processing unit 42 determines that second low-pressure pump 31 is actuated, processing unit 42 determines whether fuel supply quantity Q is not smaller than a prescribed value Q1 (step ST204). Specifically, when the discharge flow rate of high-pressure pump 33 is increased based on a quantity of fuel supplied to the internal combustion engine by in-cylinder fuel injection valves 36*a* to 36*d* serving as the high-pressure fuel supply means, that is, an in-cylinder fuel supply quantity, processing unit 42 determines whether or not occurrence of insufficient suction in high-pressure pump 33 can be suppressed only by second low-pressure pump 31. Here, prescribed value Q1 is such that, if the in-cylinder fuel supply quantity of the fuel supplied to the internal combustion engine only by in-cylinder fuel injection valves 36*a* to 36*d* implementing the high-pressure fuel supply means, that is, the fuel supply quantity, is realized only by the discharge flow rate of second low-pressure pump 31, occurrence of insufficient suction in high-pressure pump 33 cannot be suppressed. If processing unit 42 determines that second low-pressure pump 31 is not actuated, processing unit 42 actuates second low-pressure pump 31 (step ST205).

If processing unit 42 determines that fuel supply quantity Q is not smaller than prescribed value Q1, processing unit 42 determines whether or not first low-pressure pump 21 is actuated (step ST206). If processing unit 42 determines that first low-pressure pump 21 is actuated, in order to supply the fuel satisfying fuel supply quantity Q to the engine, in-cylinder injection is performed (step ST207). Here, the discharge flow rate of high-pressure pump 33 is increased, and the pressure of the low-pressure fuel within second low-pressure pipe 32 is lowered. On the other hand, first low-pressure pump 21 is actuated, and the low-pressure fuel within first low-pressure pipe 22 is maintained to a constant value (low pressure). Accordingly, there is a difference between the pressure of the low-pressure fuel within first low-pressure pipe 22 and the pressure of the low-pressure within second low-pressure pipe 32. As a result of the pressure difference, check valve 9 in connection pipe 8 is opened, to open connection pipe 8. The low-pressure fuel within first low-pressure pipe 22 is thus allowed to flow into second low-pressure pipe 32. In this manner, when the fuel is supplied to the internal combustion engine only by in-cylinder fuel injection valves 36*a* to 36*d*, that is, when in-cylinder injection is performed, occurrence of insufficient suction in high-pressure pump 33 is suppressed even when the pump attaining a small discharge flow rate is used as second low-pressure pump 31 supplying the low-pressure fuel to high-pressure pump 33. If processing unit 42 determines that first low-pressure pump 21 is not actuated, processing unit 42 actuates first low-pressure pump 21 (step ST208).

If processing unit 42 determines that fuel supply quantity Q is smaller than prescribed value Q1, processing unit 42 determines whether or not first low-pressure pump 21 is actuated (step ST209). Then, if processing unit 42 determines that first low-pressure pump 21 is not actuated, in-cylinder injection is performed (step ST207). If processing unit 42 determines that first low-pressure pump 21 is actuated, actuation of first low-pressure pump 21 is stopped (step ST210). Therefore, if the fuel can be supplied to the engine serving as the internal combustion engine only by in-cylinder fuel injection valves 36*a* to 36*d* implementing the high-pressure fuel supply means and the discharge flow rate only of second low-pressure pump 31 can suppress occurrence of insufficient suction in high-pressure pump 33, first low-pressure pump 21 is not actuated. In this manner, as compared with an example in which first low-pressure pump 21 and second low-pressure pump 31 are actuated, power consumption can be reduced.

Thereafter, if processing unit 42 determines that degree of accelerator press-down L is not smaller than prescribed value L1, processing unit 42 determines whether or not degree of accelerator press-down L is smaller than prescribed value L2 (step ST211). If degree of accelerator press-down L is smaller than prescribed value L2, ECU 4 determines the injection region as the in-cylinder/port injection region, based on the operation state of the engine serving as the internal combustion engine, as shown in FIG. 4. Thereafter, processing unit 42 determines whether first low-pressure pump 21 is actuated or not (step ST212).

If processing unit 42 determines that first low-pressure pump 21 is actuated, processing unit 42 determines whether second low-pressure pump 31 is actuated or not (step ST213). Here, if processing unit 42 determines that first low-pressure pump 21 is not actuated, first low-pressure pump 21 is actuated (step ST214).

If processing unit 42 determines that second low-pressure pump 31 is actuated, in order to supply the fuel satisfying fuel supply quantity Q to the engine, in-cylinder/port injection is performed (step ST215). If processing unit 42 determines that second low-pressure pump 31 is not actuated, second low-pressure pump 31 is actuated (step ST216). Here, in some cases, quantity Q of fuel supplied to the engine is increased, the in-cylinder fuel supply quantity is increased, and the discharge flow rate of high-pressure pump 33 is increased. In such a case, the pressure of the low-pressure fuel within second low-pressure pipe 32 is lowered, however, first low-pressure pump 21 is actuated in order to supply the fuel to the engine by using port fuel injection valves 24*a* to 24*d* implementing the low-pressure fuel supply means. That is, the pressure of the low-pressure fuel within first low-pressure pipe 22 is maintained to a constant value (low pressure), and there is a difference between the pressure of the low-pressure fuel within first low-pressure pipe 22 and the pressure of the low-pressure within second low-pressure pipe 32. As a result of the pressure difference, check valve 9 in connection pipe 8 is opened, to open connection pipe 8. The low-pressure fuel within first low-pressure pipe 22 is thus allowed to flow into second low-pressure pipe 32. In this manner, when the fuel is supplied to the internal combustion engine by in-cylinder fuel injection valves 36*a* to 36*d* and port fuel injection valves 24*a* to 24*d*, that is, when in-cylinder/port injection is performed, occurrence of insufficient suction in high-pressure pump 33 is suppressed even if a pump attaining a small discharge flow rate is used as second low-pressure pump 31 supplying the low-pressure fuel to high-pressure pump 33.

Thereafter, if processing unit 42 determines that degree of accelerator press-down L is not smaller than prescribed value L2, ECU 4 determines the injection region as the port injection region, based on the operation state of the engine serving as the internal combustion engine, as shown in FIG. 4. Thereafter, processing unit 42 determines whether first low-pressure pump 21 is actuated or not (step ST217). If processing unit 42 determines that first low-pressure pump 21 is actuated, processing unit 42 determines whether second low-pressure pump 31 is actuated or not (step ST218). Here, if processing unit 42 determines that first low-pressure pump 21 is not actuated, first low-pressure pump 21 is actuated (step ST219).

If processing unit 42 determines that second low-pressure pump 31 is not actuated, in order to supply the fuel satisfying fuel supply quantity Q to the engine, port injection is performed (step ST220). If processing unit 42 determines that second low-pressure pump 31 is actuated, processing unit 42 stops actuation of second low-pressure pump 31 (step ST221). Therefore, when the fuel is supplied to the engine serving as the internal combustion engine only by port fuel injection valves 24*a* to 24*d* implementing the low-pressure fuel supply means, second low-pressure pump 31 is not actuated. In this manner, as compared with the example in which first low-pressure pump 21 and second low-pressure pump 31 are actuated, power consumption can be reduced.

As described above, low-pressure fuel system 2 supplying the fuel to the internal combustion engine by using the low-pressure fuel supply means and high-pressure fuel system 3 supplying the fuel to the internal combustion engine by using the high-pressure fuel supply means operate independently of each other, in accordance with the operation state of the internal combustion engine. In other words, when the fuel is supplied to the engine, by in-cylinder fuel injection valves 36*a* to 36*d* and port fuel injection valves 24*a* to 24*d*, that is, when in-cylinder/port injection is performed, check valve 9 serving as the opening-closing means and allowing only flow-in of the low-pressure fuel within first low-pressure pipe 22, to which pressure has been applied, into second low-pressure pipe 32 prevents the low-pressure fuel within second low-pressure fuel pipe 32 from flowing into first low-pressure pipe 22 through connection pipe 8. Therefore, pulsation generated from high-pressure pump 33 in high-pressure fuel system 3 does not propagate to low-pressure delivery pipe 23 and port fuel injection valves 24*a* to 24*d* implementing the low-pressure fuel supply means of low-pressure fuel system 2. In addition, when the fuel is supplied to the engine only by port fuel injection valves 24*a* to 24*d*, that is, when port injection is performed as well, pulsation generated from high-pressure pump 33 in high-pressure fuel system 3 does not propagate to low-pressure delivery pipe 23 and port fuel injection valves 24*a* to 24*d* implementing the low-pressure fuel supply means of low-pressure fuel system 2. Therefore, when the fuel is injected to the engine from port fuel injection valves 24*a* to 24*d* in accordance with the operation state of the engine, influence by pulsation generated from high-pressure pump 33 on quantity Q of the fuel to be supplied to the engine can be mitigated.

Use of check valve 9 as the opening-closing means can reliably prevent pulsation generated from high-pressure pump 33 from propagating to low-pressure delivery pipe 23 and port fuel injection valves 24*a* to 24*d* implementing the low-pressure fuel supply means of low-pressure fuel system 2, when the fuel is supplied to the internal combustion engine by the high-pressure fuel supply means and the low-pressure fuel supply means, that is, when in-cylinder/port injection is performed, irrespective of the operation state of the internal combustion engine.

Third Embodiment

Figure 7:
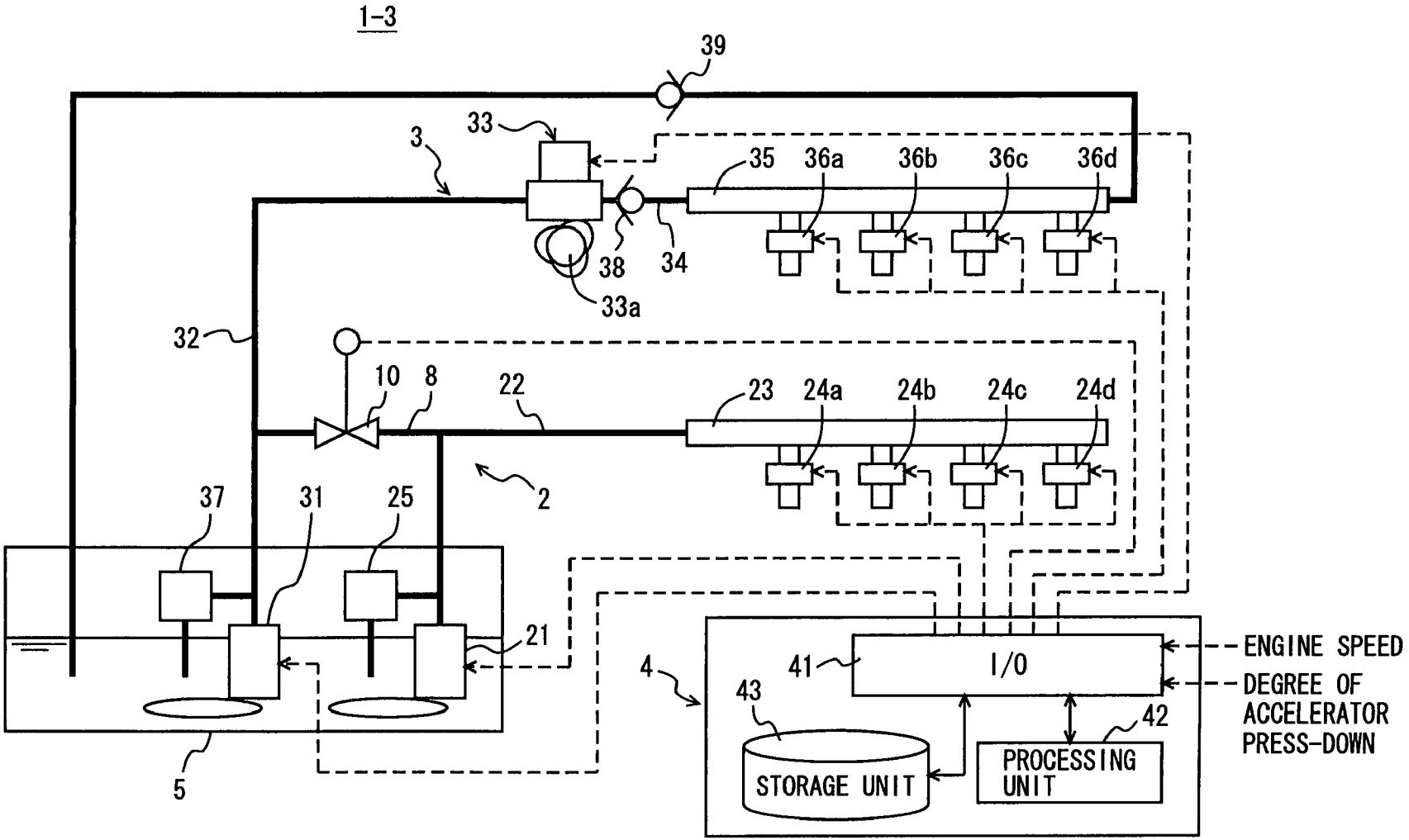
FIG. 7 illustrates a configuration example of a fuel supply apparatus for an internal combustion engine according to a third embodiment.

FIG. 7 illustrates a configuration example of the fuel supply apparatus according to the third embodiment. Fuel supply apparatus 1-3 shown in FIG. 7 is different from fuel supply apparatus 1-2 shown in FIG. 5 in that an open-close valve 10 is provided instead of check valve 9 provided in connection pipe 8. As a basic configuration of fuel supply apparatus 1-3 shown in FIG. 7 is similar to that of fuel supply apparatus 1-2 shown in FIG. 5, description thereof will not be repeated.

Open-close valve 10 allowing connection between first low-pressure pipe 22 and second low-pressure pipe 32 through connection pipe 8 is provided in connection pipe 8. That is, open-close valve 10 provided in connection pipe 8 serves to open and close connection pipe 8. Opening and closing of open-close valve 10 is controlled by ECU 4. Specifically, open-close valve 10 opens in response to output of an open-close signal from ECU 4, and closes in response to stop of the open-close signal output from ECU 4. In the third embodiment, pumps similar to those in the second embodiment are employed as first low-pressure pump 21 and second low-pressure pump 31. Specifically, if the discharge flow rate of the low-pressure pump in the conventional fuel supply apparatus for the internal combustion engine is assumed as 1.0, for example, first low-pressure pump 21 is implemented by a low-pressure pump attaining a discharge flow rate of approximately 0.8, and second low-pressure pump 31 is implemented also by a low-pressure pump attaining a discharge flow rate of approximately 0.8. In addition, in the third embodiment, as in the second embodiment, the prescribed pressure when the low-pressure fuel is returned to fuel tank 5 by first regulator 25 and second regulator 37 is assumed as the same. Accordingly, when the pressure of the low-pressure fuel within second low-pressure pipe 32 of high-pressure fuel system 3 is lowered, open-close valve 10 is opened in response to the open-close signal from ECU 4. As a result, the low-pressure fuel within first low-pressure pipe 22 of low-pressure fuel system 2, of which pressure is maintained to a constant value (low pressure), can reliably be supplied to second low-pressure pipe 32 from open-close valve 10 through connection pipe 8.

Figure 8A:
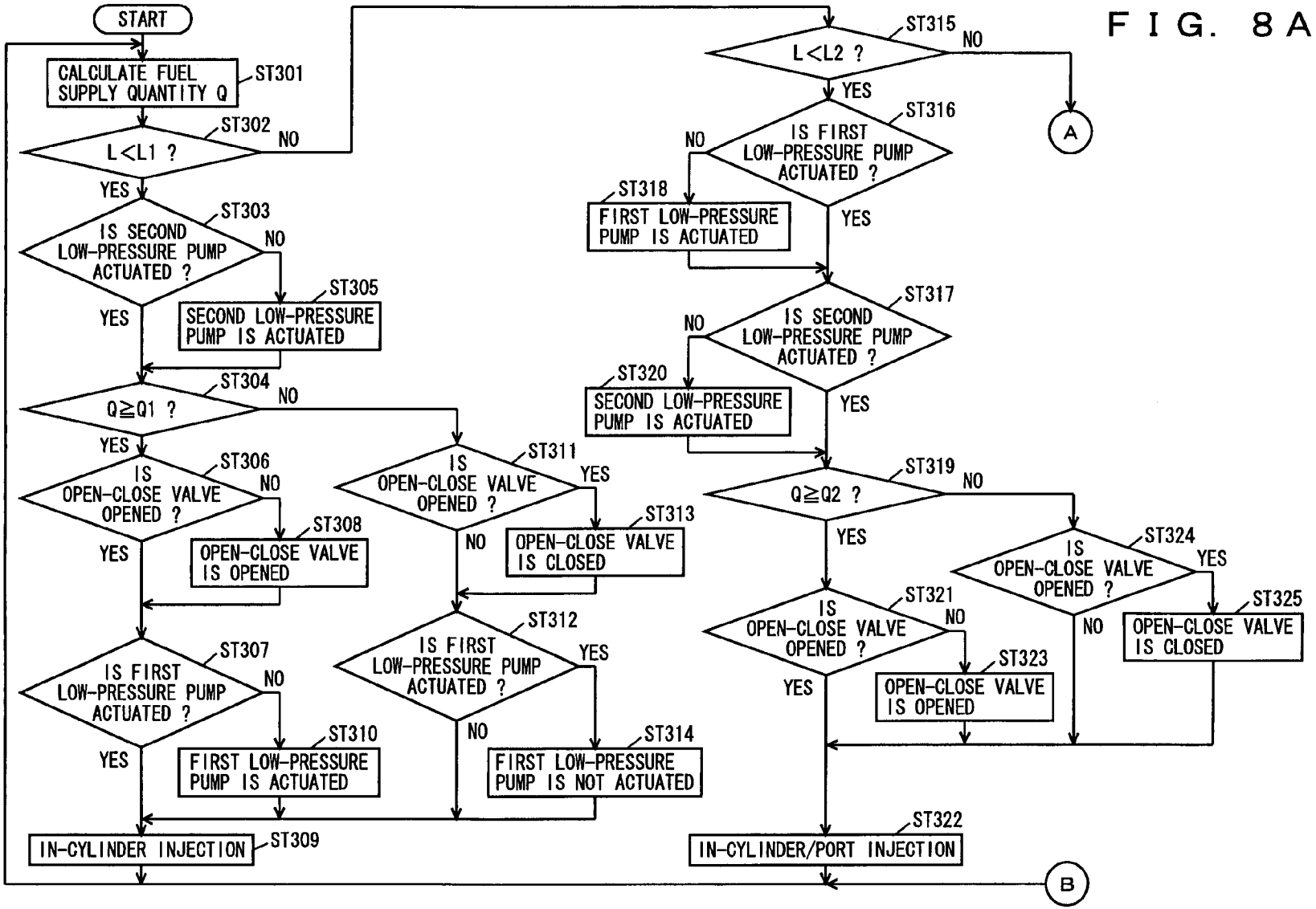
FIGS. 8A and 8B illustrate an operation flow in the fuel supply apparatus for the internal combustion engine according to the third embodiment.
Figure 8B:
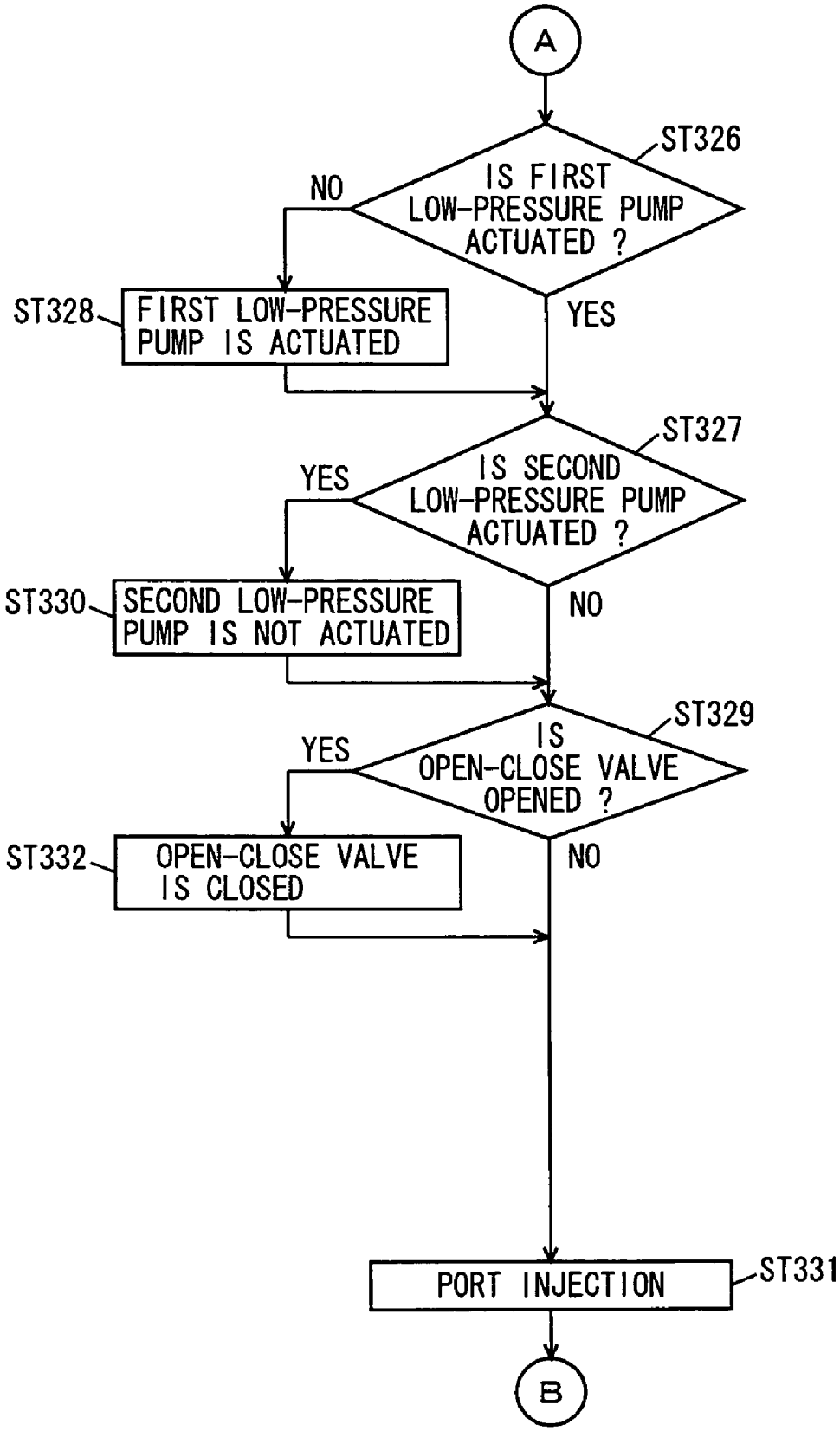

A manner of operation of fuel supply apparatus 1-3 for the internal combustion engine according to the third embodiment will now be described. FIGS. 8A and 8B illustrate an operation flow in the fuel supply apparatus for the internal combustion engine according to the third embodiment. As the manner of operation of fuel supply apparatus 1-3 shown in FIGS. 8A and 8B is basically the same as that of fuel supply apparatus 1-2 shown in FIG. 6, description thereof will be simplified. Initially, as shown in FIGS. 8A and 8B, processing unit 42 of ECU 4 calculates quantity Q of fuel to be supplied to the engine (step ST301). Thereafter, processing unit 42 determines whether degree of accelerator press-down L is smaller than prescribed value L1 (step ST302). When degree of accelerator press-down L is smaller than prescribed value L1, ECU 4 serving as the pump control means determines the injection region as the in-cylinder injection region, based on the operation state of the engine serving as the internal combustion engine, as shown in FIG. 4. Thereafter, processing unit 42 determines whether second low-pressure pump 31 is actuated or not (step ST303).

If processing unit 42 determines that second low-pressure pump 31 is actuated, processing unit 42 determines whether fuel supply quantity Q is not smaller than prescribed value Q1 (step ST304). Here, prescribed value Q1 is such that, if the in-cylinder fuel supply quantity of the fuel supplied to the internal combustion engine only by in-cylinder fuel injection valves 36*a* to 36*d* implementing the high-pressure fuel supply means, that is, the fuel supply quantity, is realized only by the discharge flow rate of second low-pressure pump 31, occurrence of insufficient suction in high-pressure pump 33 cannot be suppressed. If processing unit 42 determines that second low-pressure pump 31 is not actuated, processing unit 42 actuates second low-pressure pump 31 (step ST305).

If processing unit 42 determines that fuel supply quantity Q is not smaller than prescribed value Q1, processing unit 42 determines whether open-close valve 10 is open or not (step ST306). If processing unit 42 determines that open-close valve 10 is open, processing unit 42 determines whether first low-pressure pump 21 is actuated or not (step ST307). If processing unit 42 determines that open-close valve 10 is closed, an open-close signal is output from ECU 4, so as to open open-close valve 10 (step ST308).

If processing unit 42 determines that first low-pressure pump 21 is actuated, in order to supply the fuel satisfying fuel supply quantity Q to the engine, in-cylinder injection is performed (step ST309). Then, the discharge flow rate of high-pressure pump 33 is increased, and the pressure of the low-pressure fuel within second low-pressure pipe 32 is lowered. Here, however, open-close valve 10 is opened, and first low-pressure pump 21 is actuated. Therefore, the pressure of the low-pressure fuel within first low-pressure pipe 22 is maintained to a constant value (low pressure) and there is a difference between the pressure of the low-pressure fuel within first low-pressure pipe 22 and the pressure of the low-pressure within second low-pressure pipe 32. As a result of the pressure difference, the low-pressure fuel within first low-pressure pipe 22 flows into second low-pressure pipe 32 through connection pipe 8. In this manner, when the fuel is supplied to the internal combustion engine only by in-cylinder fuel injection valves 36*a* to 36*d*, that is, when in-cylinder injection is performed, occurrence of insufficient suction in high-pressure pump 33 is suppressed even if the pump attaining a small discharge flow rate is used as second low-pressure pump 31 supplying the low-pressure fuel to high-pressure pump 33. If processing unit 42 determines that first low-pressure pump 21 is not actuated, processing unit 42 actuates first low-pressure pump 21 (step ST310).

If processing unit 42 determines that fuel supply quantity Q is smaller than prescribed value Q1, processing unit 42 determines whether open-close valve 10 is open or not (step ST311). If processing unit 42 determines that open-close valve 10 is closed, processing unit 42 determines whether first low-pressure pump 21 is actuated or not (step ST312). If processing unit 42 determines that open-close valve 10 is open, the open-close signal output from ECU 4 is stopped, so as to close open-close valve 10 (step ST313).

If processing unit 42 determines that first low-pressure pump 21 is not actuated, in-cylinder injection is performed (step ST309). If processing unit 42 determines that first low-pressure pump 21 is actuated, actuation of first low-pressure pump 21 is stopped (step ST314). Therefore, if the fuel can be supplied to the engine serving as the internal combustion engine only by in-cylinder fuel injection valves 36*a* to 36*d* implementing the high-pressure fuel supply means and the discharge flow rate only of second low-pressure pump 31 can suppress occurrence of insufficient suction in high-pressure pump 33, first low-pressure pump 21 is not actuated. In this manner, as compared with an example in which first low-pressure pump 21 and second low-pressure pump 31 are actuated, power consumption can be reduced.

If processing unit 42 determines that degree of accelerator press-down L is not smaller than prescribed value L1, processing unit 42 determines whether degree of accelerator press-down L is smaller than prescribed value L2 (step ST315). If degree of accelerator press-down L is smaller than prescribed value L2, ECU 4 determines the injection region as the in-cylinder/port injection region, based on the operation state of the engine serving as the internal combustion engine, as shown in FIG. 4. Thereafter, processing unit 42 determines whether first low-pressure pump 21 is actuated or not (step ST316).

If processing unit 42 determines that first low-pressure pump 21 is actuated, processing unit 42 determines whether second low-pressure pump 31 is actuated or not (step ST317). Here, if processing unit 42 determines that first low-pressure pump 21 is not actuated, first low-pressure pump 21 is actuated (step ST318).

If processing unit 42 determines that second low-pressure pump 31 is actuated, processing unit 42 determines whether fuel supply quantity Q is not smaller than a prescribed value Q2 (step ST319). Specifically, when the discharge flow rate of high-pressure pump 33 is increased based on a quantity of fuel supplied to the internal combustion engine by in-cylinder fuel injection valves 36*a* to 36*d* serving as the high-pressure fuel supply means, that is, the in-cylinder fuel supply quantity, processing unit 42 determines whether or not occurrence of insufficient suction in high-pressure pump 33 can be suppressed only by second low-pressure pump 31. Here, prescribed value Q2 refers to such a fuel supply quantity that, if the in-cylinder fuel supply quantity of the fuel supplied to the internal combustion engine only by in-cylinder fuel injection valves 36*a* to 36*d* implementing the high-pressure fuel supply means is realized only by the discharge flow rate of second low-pressure pump 31, occurrence of insufficient suction in high-pressure pump 33 cannot be suppressed. If processing unit 42 determines that second low-pressure pump 31 is not actuated, processing unit 42 actuates second low-pressure pump 31 (step ST320).

Thereafter, if processing unit 42 determines that fuel supply quantity Q is not smaller than prescribed value Q2, processing unit 42 determines whether open-close valve 10 is open or not (step ST321). If processing unit 42 determines that open-close valve 10 is open, in order to supply the fuel satisfying fuel supply quantity Q to the engine, in-cylinder/port injection is performed (step ST322). If processing unit 42 determines that open-close valve 10 is closed, an open-close signal is output from ECU 4, so as to open open-close valve 10 (step ST323). In some cases, the discharge flow rate of high-pressure pump 33 is increased, and the pressure of the low-pressure fuel within second low-pressure pipe 32 is lowered. Here, however, first low-pressure pump 21 is actuated in order to supply the fuel to the engine by using port fuel injection valves 24*a* to 24*d* implementing the low-pressure fuel supply means. That is, the pressure of the low-pressure fuel within first low-pressure pipe 22 is maintained to a constant value (low pressure) and there is a difference between the pressure of the low-pressure fuel within first low-pressure pipe 22 and the pressure of the low-pressure within second low-pressure pipe 32. As a result of the pressure difference, open-close valve 10 in connection pipe 8 is opened to open connection pipe 8, and the low-pressure fuel within first low-pressure pipe 22 flows into second low-pressure pipe 32. In this manner, when the fuel is supplied to the internal combustion engine by in-cylinder fuel injection valves 36*a* to 36*d* and port fuel injection valves 24*a* to 24*d*, that is, when in-cylinder/port injection is performed, occurrence of insufficient suction in high-pressure pump 33 is suppressed even if the pump attaining a small discharge flow rate is used as second low-pressure pump 31 supplying the low-pressure fuel to high-pressure pump 33.

If processing unit 42 determines that fuel supply quantity Q is smaller than prescribed value Q2, processing unit 42 determines whether open-close valve 10 is open or not (step ST324). If processing unit 42 determines that open-close valve 10 is closed, in-cylinder/port injection is performed (step ST322). If processing unit 42 determines that open-close valve 10 is open, the open-close signal output from ECU 4 is stopped in order to close open-close valve 10 (step ST325), and in-cylinder/port injection is-performed (step ST322).

If processing unit 42 determines that degree of accelerator press-down L is not smaller than prescribed value L2, ECU 4 determines the injection region as the port injection region, based on the operation state of the engine serving as the internal combustion engine, as shown in FIG. 4. Thereafter, processing unit 42 determines whether first low-pressure pump 21 is actuated or not (step ST326). If processing unit 42 determines that first low-pressure pump 21 is actuated, processing unit 42 determines whether second low-pressure pump 31 is actuated or not (step ST327). Here, if processing unit 42 determines that first low-pressure pump 21 is not actuated, first low-pressure pump 21 is actuated (step ST328).

If processing unit 42 determines that second low-pressure pump 31 is not actuated, processing unit 42 determines whether open-close valve 10 is open or not (step ST329). If processing unit 42 determines that second low-pressure pump 31 is actuated, actuation of second low-pressure pump 31 is stopped (step ST330).

If processing unit 42 determines that open-close valve 10 is closed, port injection is performed (step ST331). If processing unit 42 determines that open-close valve 10 is open, the open-close signal output from ECU 4 is stopped in order to close open-close valve 10 (step ST332), and port injection is performed (step ST331). Therefore, when the fuel is supplied to the engine serving as the internal combustion engine only by port fuel injection valves 24*a* to 24*d* implementing the low-pressure fuel supply means, second low-pressure pump 31 is not actuated. In this manner, as compared with the example in which first low-pressure pump 21 and second low-pressure pump 31 are actuated, power consumption can be reduced.

As described above, low-pressure fuel system 2 supplying the fuel to the internal combustion engine by using the low-pressure fuel supply means and high-pressure fuel system 3 supplying the fuel to the internal combustion engine by using the high-pressure fuel supply means operate independently of each other, in accordance with the operation state of the internal combustion engine. In other words, when the fuel is supplied to the engine by in-cylinder fuel injection valves 36*a* to 36*d* and port fuel injection valves 24*a* to 24*d*, that is, when in-cylinder/port injection is performed, if fuel supply quantity Q is smaller than prescribed value Q2, that is, if solely second low-pressure pump 31 realizing the in-cylinder fuel supply quantity of the fuel to be supplied to the engine by in-cylinder fuel injection valves 36*a* to 36*d* can suppress occurrence of insufficient suction in high-pressure pump 33, open-close valve 10 serving as the opening-closing means is closed. Then, flow-in of the low-pressure fuel within second low-pressure fuel pipe 32 into first low-pressure pipe 22 through connection pipe 8 is avoided. Therefore, propagation of pulsation generated from high-pressure pump 33 in high-pressure fuel system 3 to low-pressure delivery pipe 23 and port fuel injection valves 24*a* to 24*d* implementing the low-pressure fuel supply means of low-pressure fuel system 2 can be suppressed. In addition, when the fuel is supplied to the engine only by port fuel injection valves 24*a* to 24*d*, that is, when port injection is performed, pulsation generated from high-pressure pump 33 in high-pressure fuel system 3 does not propagate to low-pressure delivery pipe 23 and port fuel injection valves 24*a* to 24*d* implementing the low-pressure fuel supply means of low-pressure fuel system 2, by closing open-close valve 10 serving as the opening-closing means. In this manner, when the fuel is injected to the engine from port fuel injection valves 24*a* to 24*d* in accordance with the operation state of the engine, influence by pulsation generated from high-pressure pump 33 on quantity Q of fuel to be supplied to the engine can be mitigated.

Use of open-close valve 10 as the opening-closing means can achieve reduction in pressure loss of the low-pressure fuel that flows from first low-pressure pipe 22 into second low-pressure pipe 32, as compared with the second embodiment employing check valve 9 as the opening-closing means.

In the third embodiment, the prescribed pressure when the low-pressure fuel is returned to fuel tank 5 by first regulator 25 and second regulator 37 is assumed as the same. Therefore, steps ST311, ST313, ST329, and ST332 may not be performed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fuel supply apparatus for an internal combustion engine, comprising:

a low-pressure fuel system applying pressure to a fuel within an accumulator by using a first low-pressure pump and supplying the fuel to low-pressure fuel supply means through a first low-pressure pipe;

a high-pressure fuel system applying pressure to the fuel in said accumulator by using a second low-pressure pump, applying further pressure through a second low-pressure pipe to the fuel by a high-pressure pump driven by the internal combustion engine, and supplying the fuel to high-pressure fuel supply means provided separately from said low-pressure fuel supply means; and pump control means for controlling actuation of at least said first low-pressure pump and said second low-pressure pump in accordance with an operation state of the internal combustion engine.

2. The fuel supply apparatus for an internal combustion engine according to claim 1, wherein said pump control means actuates said first low-pressure pump and disallows actuation of said second low-pressure pump when the fuel is supplied to said internal combustion engine solely by said low-pressure fuel supply means, and said pump control means disallows actuation of said first low-pressure pump and actuates said second low-pressure pump when the fuel is supplied to said internal combustion engine solely by said high-pressure fuel supply means.

3. A fuel supply apparatus for an internal combustion engine, comprising:

a low-pressure fuel system applying pressure to a fuel within an accumulator by using a first low-pressure pump and supplying the fuel to low-pressure fuel supply means through a first low-pressure pipe;

a high-pressure fuel system applying pressure to the fuel in said accumulator by using a second low-pressure pump, applying further pressure through a second low-pressure pipe to the fuel by a high-pressure pump driven by the internal combustion engine, and supplying the fuel to high-pressure fuel supply means provided separately from said low-pressure fuel supply means;

a connection pipe connecting between said first low-pressure pipe and said second low-pressure pipe;

opening-closing means for opening and closing said connection pipe in accordance with an operation state of the internal combustion engine; and pump control means for controlling actuation of at least said first low-pressure pump and said second low-pressure pump in accordance with the operation state of the internal combustion engine.

4. The fuel supply apparatus for an internal combustion engine according to claim 3, wherein said opening-closing means is a check valve allowing solely flow-in of said fuel within said first low-pressure pipe, to which pressure has been applied, into said second low-pressure pipe.

5. The fuel supply apparatus for an internal combustion engine according to claim 4, wherein said pump control means actuates said first low-pressure pump and disallows actuation of said second low-pressure pump when the fuel is supplied to said internal combustion engine solely by said low-pressure fuel supply means, and said pump control means actuates said first low-pressure pump and said second low-pressure pump when the fuel is supplied to said internal combustion engine solely by said high-pressure fuel supply means and a quantity of fuel supply to said internal combustion engine by said high-pressure fuel supply means is equal to or larger than a prescribed value.

6. The fuel supply apparatus for an internal combustion engine according to claim 5, wherein said opening-closing means is an open-close valve of which opening and closing is controlled by said pump control means.

7. The fuel supply apparatus for an internal combustion engine according to claim 6, wherein said pump control means closes said open-close valve, actuates said first low-pressure pump, and disallows actuation of said second low-pressure pump, when the fuel is supplied to said internal combustion engine solely by said low-pressure fuel supply means, said pump control means opens said open-close valve and actuates said first low-pressure pump and said second low-pressure pump, when the fuel is supplied to said internal combustion engine solely by said high-pressure fuel supply means and a quantity of fuel supply to said internal combustion engine by said high-pressure fuel supply means is equal to or larger than a prescribed value, and said pump control means actuates said first low-pressure pump and said second low-pressure pump when the fuel is supplied to said internal combustion engine by said low-pressure fuel supply means and said high-pressure fuel supply means, and said pump control means opens said open-close valve when a quantity of fuel supply to said internal combustion engine by said high-pressure fuel supply means is equal to or larger than the prescribed value.

8. The fuel supply apparatus for an internal combustion engine according to claim 3, further comprising:

first pressure regulation means for returning the fuel within said first low-pressure pipe to said accumulator when pressure in said first low-pressure pipe of said low-pressure fuel system is equal to or higher than a prescribed pressure; and second pressure regulation means for returning the fuel within said second low-pressure pipe to said accumulator when pressure in said second low-pressure pipe of said high-pressure fuel system is equal to or higher than a prescribed pressure; wherein said prescribed pressure is identical in said first pressure regulation means and said second pressure regulation means.

9. A fuel supply apparatus for an internal combustion engine, comprising:

a low-pressure fuel system applying pressure to a fuel within an accumulator by using a first low-pressure pump and supplying the fuel to a low-pressure fuel supply portion through a first low-pressure pipe;

a high-pressure fuel system applying pressure to the fuel in said accumulator by using a second low-pressure pump, applying further pressure through a second low-pressure pipe to the fuel by a high-pressure pump driven by the internal combustion engine, and supplying the fuel to a high-pressure fuel supply portion provided separately from said low-pressure fuel supply means; and a pump control unit for controlling actuation of at least said first low-pressure pump and said second low-pressure pump in accordance with an operation state of the internal combustion engine.

10. The fuel supply apparatus for an internal combustion engine according to claim 9, wherein said pump control unit actuates said first low-pressure pump and disallows actuation of said second low-pressure pump when the fuel is supplied to said internal combustion engine solely by said low-pressure fuel supply portion, and said pump control unit disallows actuation of said first low-pressure pump and actuates said second low-pressure pump when the fuel is supplied to said internal combustion engine solely by said high-pressure fuel supply portion.

11. A fuel supply apparatus for an internal combustion engine, comprising:

a low-pressure fuel system applying pressure to a fuel within an accumulator by using a first low-pressure pump and supplying the fuel to a low-pressure fuel supply portion through a first low-pressure pipe;

a high-pressure fuel system applying pressure to the fuel in said accumulator by using a second low-pressure pump, applying further pressure through a second low-pressure pipe to the fuel by a high-pressure pump driven by the internal combustion engine, and supplying the fuel to a high-pressure fuel supply portion provided separately from said low-pressure fuel supply means;

a connection pipe connecting between said first low-pressure pipe and said second low-pressure pipe;

an opening-closing portion for opening and closing said connection pipe in accordance with an operation state of the internal combustion engine; and a pump control unit for controlling actuation of at least said first low-pressure pump an second low-pressure pump in accordance with the operation state of the internal combustion engine.

12. The fuel supply apparatus for an internal combustion engine according to claim 11, wherein said opening-closing portion is a check valve allowing solely flow-in of said fuel within said first low-pressure pipe, to which pressure has been applied, into said second low-pressure pipe.

13. The fuel supply apparatus for an internal combustion engine according to claim 12, wherein said pump control unit actuates said first low-pressure pump and disallows actuation of said second low-pressure pump when the fuel is supplied to said internal combustion engine solely by said low-pressure fuel supply portion, and said pump control unit actuates said first low-pressure pump and said second low-pressure pump when the fuel is supplied to said internal combustion engine solely by said high-pressure fuel supply portion and a quantity of fuel supply to said internal combustion engine by said high-pressure fuel supply portion is equal to or larger than a prescribed value.

14. The fuel supply apparatus for an internal combustion engine according to claim 13, wherein said opening-closing portion is an open-close valve of which opening and closing is controlled by said pump control unit.

15. The fuel supply apparatus for an internal combustion engine according to claim 14, wherein said pump control unit closes said open-close valve, actuates said first low-pressure pump, and disallows actuation of said second low-pressure pump, when the fuel is supplied to said internal combustion engine solely by said low-pressure fuel supply portion, said pump control unit opens said open-close valve and actuates said first low-pressure pump and said second low-pressure pump, when the fuel is supplied to said internal combustion engine solely by said high-pressure fuel supply portion and a quantity of fuel supply to said internal combustion engine by said high-pressure fuel supply portion is equal to or larger than a prescribed value, and said pump control unit actuates said first low-pressure pump and said second low-pressure pump when the fuel is supplied to said internal combustion engine by said low-pressure fuel supply portion and said high-pressure fuel supply portion, and said pump control unit opens said open-close valve when a quantity of fuel supply to said internal combustion engine by said high-pressure fuel supply portion is equal to or larger than the prescribed value.

16. The fuel supply apparatus for an internal combustion engine according to claim 11, further comprising:

a first pressure regulation portion for returning the fuel within said first low-pressure pipe to said accumulator when pressure in said first low-pressure pipe of said low-pressure fuel system is equal to or higher than a prescribed pressure; and a second pressure regulation portion for returning the fuel within said second low-pressure pipe to said accumulator when pressure in said second low-pressure pipe of said high-pressure fuel system is equal to or higher than a prescribed pressure; wherein said prescribed pressure is identical in said first pressure regulation portion and said second pressure regulation portion.

* * * * *

UNITED STATES PATENT AND TRADEMARK OFFICE

CERTIFICATE OF CORRECTION

PATENT NO. : 7,328,687 B2
APPLICATION NO. : 11/114129
DATED : February 12, 2008
INVENTOR(S) : Susumu Kojima It is certified that error appears in the above-identified patent and that said Letters Patent is hereby corrected as shown below:

In the Title Page: Change "(75) Inventor: Susumu Kojima, Susomo (JP)" to --(75) Inventor: Susumu Kojima, Susono (JP)--

| Column | Line | |
|---|---|---|
| 6 | 18 | Change "includes" to --include--. |
| 8 | 26-27 | Change "valves **36***a* to **36***a*" to --valves **36***a* to **36***d*--. |
| 9 | 61 | Change "an ROM" to --a ROM--. |
| 9 | 62 | Change "an RAM" to --a RAM--. |
| 10 | 35-36 | Change "valves **36***a* to **36***a*" to --valves **36***a* to **36***d*--. |
| 11 | 23-24 | Change "valves **36***a* to **36***a*" to --valves **36***a* to **36***d*--. |
| 12 | 7 | Change "valves **24***a* to **24***a*" to --valves **24***a* to **24***d*--. |
| 18 | 2 | Change "to stop of" to --to a stop of--. |

Signed and Sealed this

Fourteenth Day of October, 2008

JON W. DUDAS
*Director of the United States Patent and Trademark Office*